US007147392B2

(12) United States Patent
Bedhome et al.

(10) Patent No.: US 7,147,392 B2
(45) Date of Patent: Dec. 12, 2006

(54) COMBINATION WRITING INSTRUMENT

(75) Inventors: Vincent Bedhome, Desvres (FR); Kenneth R. Cooper, Orange, CT (US); David Anthony Edgerley, London (GB); Douglas Hungerford, Southington, CT (US); Didier Lange, St. Leonard (FR); Robert Edward Matthews, London (GB); Franck Rollion, Belloy en France (FR); Anthony Wlodarczyk, Yucaipa, CA (US); Ryan Eddington, Dallas City, IL (US)

(73) Assignee: Societe BIC, Clichy, Cedex (FR)

( * ) Notice: Subject to any disclaimer, the term of this patent is extended or adjusted under 35 U.S.C. 154(b) by 164 days.

(21) Appl. No.: 10/828,020

(22) Filed: Apr. 19, 2004

(65) Prior Publication Data

US 2005/0100388 A1 May 12, 2005

Related U.S. Application Data

(63) Continuation-in-part of application No. 10/706,315, filed on Nov. 11, 2003, now abandoned.

(51) Int. Cl.
*B43K 27/04* (2006.01)
*B43K 27/08* (2006.01)

(52) U.S. Cl. ..... 401/35; 401/29

(58) Field of Classification Search ..... 401/16, 401/17, 29–35

See application file for complete search history.

(56) References Cited

U.S. PATENT DOCUMENTS

| | | | | |
|---|---|---|---|---|
| 1,533,162 A | | 4/1925 | Chesne | |
| 1,738,367 A | | 12/1929 | Haught | |
| 1,827,311 A | | 10/1931 | Felipe | |
| 3,083,690 A | | 4/1963 | Marban | 120/42.16 |
| 3,247,828 A | | 4/1966 | Basham | 120/45.6 |
| 3,336,909 A | | 8/1967 | Diamond | 120/44 |
| 3,687,562 A | | 8/1972 | Basham | 401/230 |
| 4,352,579 A | | 10/1982 | Yi | 401/19 |
| 4,533,271 A | | 8/1985 | Sansevero | |
| 4,580,918 A | | 4/1986 | Baker et al. | 401/29 |
| 5,026,189 A | | 6/1991 | Keil | 401/29 |
| 5,203,638 A | | 4/1993 | Redmond, Jr. | 401/17 |
| 5,611,687 A | * | 3/1997 | Wagner | 433/80 |

FOREIGN PATENT DOCUMENTS

| | | |
|---|---|---|
| JP | 8034195 | 2/1996 |
| WO | WO 02/064379 | 8/2002 |

* cited by examiner

*Primary Examiner*—Huyen Le
(74) *Attorney, Agent, or Firm*—Jones Day

(57) ABSTRACT

A writing instrument, which has an inner and outer writing element with separate writing medium reservoirs. The writing elements are coaxially mounted in an outer barrel and axially moveable with respect to one another. A driving mechanism may be actuated to allow a user to selectively extend one writing element. The inner and outer writing elements may have an inner sleeve therebetween to improve, for instance, rigidity of the outer writing element and to prevent contamination of the writing medium reservoirs. An outer sleeve may also be provided over the outer writing element. The outer sleeve can function to hold various components of the outer writing element together, and to allow for clean and easy refill of the outer writing element, especially when the outer writing element is a porous nib with a filler-type writing medium reservoir. The writing instrument is designed so that a user can replace the inner and/or outer writing elements when their respective writing medium have been expended.

27 Claims, 13 Drawing Sheets

COMBINATION WRITING INSTRUMENT

CROSS-REFERENCE TO RELATED APPLICATION

The present application is a continuation-in-part of U.S. patent application Ser. No. 10/706,315 filed Nov. 11, 2003 now abandoned, which application is hereby incorporated by reference in its entirety.

FIELD OF THE INVENTION

The present invention relates to a writing instrument and, in particular, a writing instrument having at least two writing elements that are axially moveable with respect to one another, and more particularly, with one writing element being disposed within the other writing element. The present invention also relates to improvements to filler-type writing instruments.

BACKGROUND OF THE INVENTION

Writing instruments having multiple writing elements are well known in the art. For the most part, these writing instruments have a plurality of writing elements disposed adjacent (side-by-side) to one another within a pen barrel. Prior art writing instruments have combined a variety of types of writing elements, including ball point pens, highlighters, and markers, in various combinations (e.g., all the same type, one of each, or more than one of more than one type). A drive mechanism is actuated to displace the writing tip of one of the writing elements to a position outside the barrel. In some cases, one writing instrument is already in a fixed position outside the barrel and the second writing element is moveable.

In order for the moveable writing element to be used for writing, it must be projected out of the barrel past the distal-most portion of the fixed writing element. In other known writing instruments, the distal-most portion of the moveable writing element—when fully projected—is in the same plane as the distal-most portion of the fixed writing element. Therefore, the two writing elements can produce two lines, or a line with a thickness greater than either writing element individually. Also, if the writing elements are supplied by two different writing mediums, two different lines can be produced.

The disadvantage of side-by-side construction is that the diameter of the pen barrel housing the writing elements must be greater than the diameter of a standard pen having only one writing element. To create a more compact writing implement, prior art devices have mounted the writing elements coaxially (i.e., one writing element disposed within another writing element), whereby the inner writing element is moveable relative to the outer writing element.

Various compact, multiple-writing-element writing instruments currently exist. These instruments have several distinguishing features. For example, U.S. Pat. No. 5,026,189, filed on Apr. 5, 1990, and issued to George Keil on Jun. 25, 1991, discloses a writing instrument having a pen barrel with two writing elements coaxially mounted therein. The inner writing element moves axially relative to the outer writing element. In one embodiment, each writing element has its own ink reservoir. The driving mechanism for moving the inner writing element relative to the outer writing element, however, is located towards the center of the pen barrel. Consequently, the writing tips must be separated from their respective ink reservoirs. The construction of such a writing instrument thus is complex and difficult to assemble en mass. Other prior art devices have inner and outer writing elements that share a common ink reservoir, such as shown in U.S. Pat. No. 4,580,918 to Baker et al. Such a configuration is undesirable if an operator wants to use different types of writing mediums.

In addition, prior art writing instruments with multiple writing elements have not succeeded in providing disparate writing elements in a compact body having an outer diameter that is not significantly larger than the outer diameter of a standard, single writing element writing instrument. Thus, in order to provide a writing element such as a pen with a marking element such as a marker or highlighter, the writing tips have been provided on opposite ends of the writing instrument to maintain a streamlined appearance and relatively standard outer diameter for a writing instrument. Use of such writing instruments results in wasted motion when manipulating the orientation of the writing instrument to switch between writing ends to achieve different writing or marking modalities. Also, each writing element typically is covered by a separate cap. Thus, the use of both writing elements during a single writing/marking task requires the further wasted motions of removing and replacing two caps, instead of a single or no cap. Moreover, the user has to keep track of two caps, instead of a single or no cap.

SUMMARY OF THE INVENTION

A writing instrument in accordance with one aspect of the present invention has an outer barrel housing an inner writing element coaxially mounted within an outer writing element. The writing elements are axially moveable with respect to each other. Preferably, the inner writing element is made of a material chosen for its rigidity and resistance to corrosion.

In order to operate the writing instrument of the present invention, at least one writing element is connected to a driving mechanism. The driving mechanism causes axial movement of one writing element with respect to the other writing element. In operation, one writing element may be fixed so that at least a portion of its writing tip remains outside the barrel, allowing the writing instrument to be used to mark a writing surface. The other writing element is axially moveable. Upon actuation of the driving mechanism, the moveable writing element is extended from the barrel so that its distal-most portion extends beyond the distal-most portion of the fixed writing element. Now, the moveable writing element can be used to mark a writing surface.

In accordance with another aspect of the present invention, a writing instrument is provided with a replaceable filler-type writing element having a a filler-type writing medium reservoir and a porous nib. A fluid-impervious sleeve preferably covers at least a portion of the porous nib and/or the filler-type writing medium reservoir of the writing element. The sleeve enables the user to handle the filler-type writing medium reservoir and the porous nib without getting writing medium on his/her hands and/or fingers. To enable refill of the writing element, the outer barrel of the writing instrument is designed to permit access to the writing element.

The construction of a writing instrument as described herein meets the needs of modern day users of writing instruments. Such a construction allows two different writing elements (e.g., pen and highlighter/marker) to be used. For example, those who edit written works can perform two independent functions—annotating and highlighting—with the same writing instrument.

BRIEF DESCRIPTION OF THE DRAWINGS

The present invention can be better understood by reference to the following drawings, wherein like references numerals represent like elements. The drawings are merely exemplary and the present invention is not limited to the embodiments shown.

DETAILED DESCRIPTION OF THE INVENTION

Figure 1:
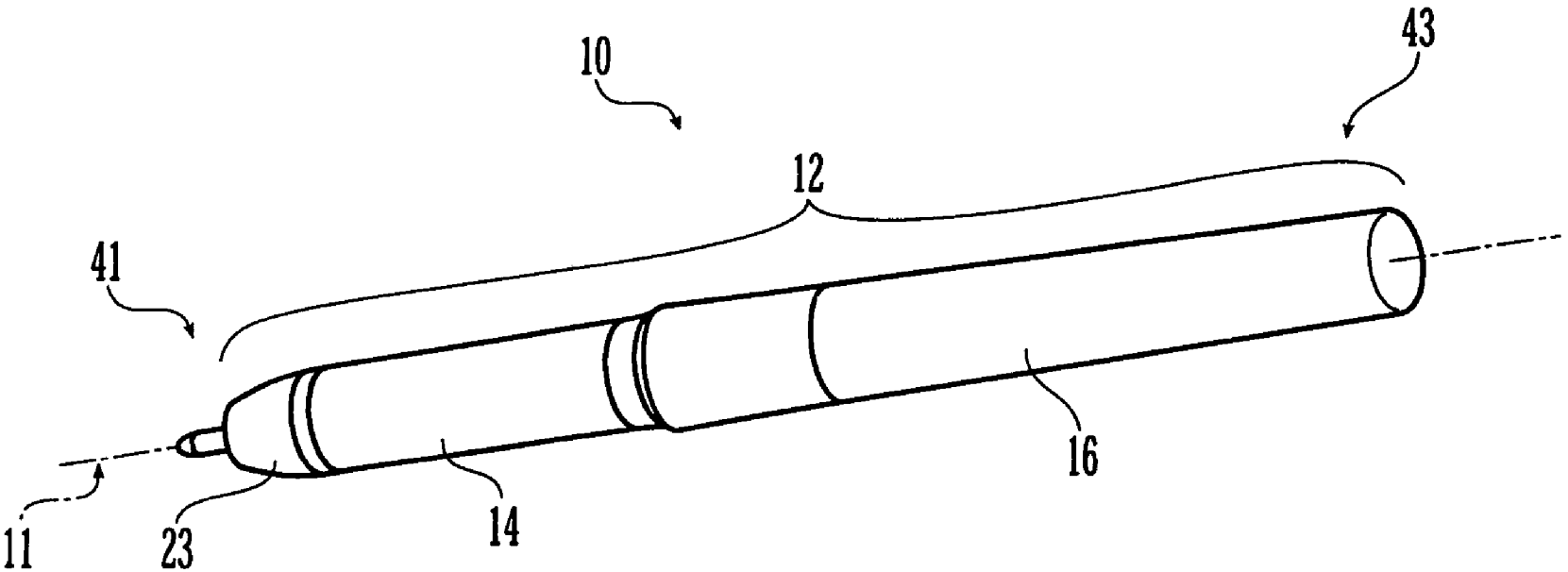
FIG. 1 is an elevational view of an exemplary writing instrument formed in accordance with principles of the present invention.
Figure 2:
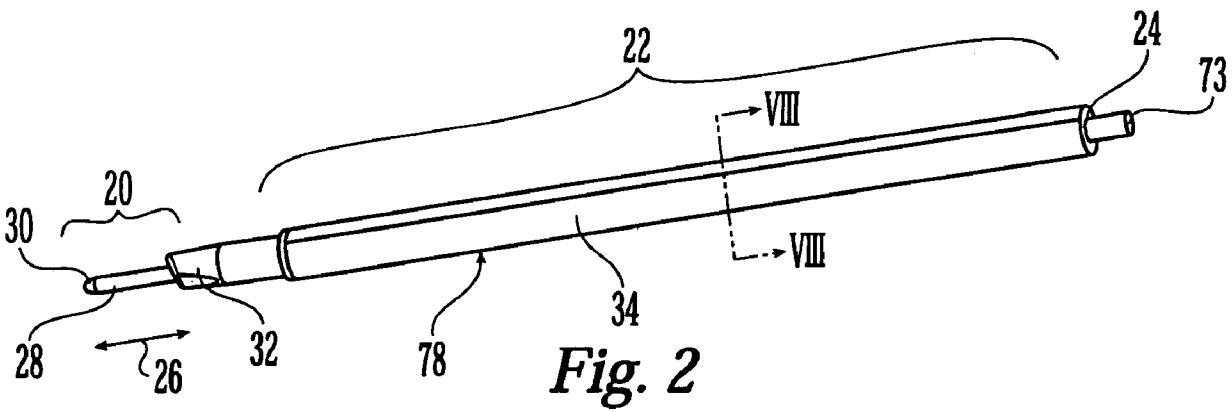
FIG. 2 is a perspective view of two writing elements that may be used in a writing instrument formed in accordance with the principles of the present invention, the writing elements being shown in isolation with one writing element inserted over the other writing element.
Figure 3:
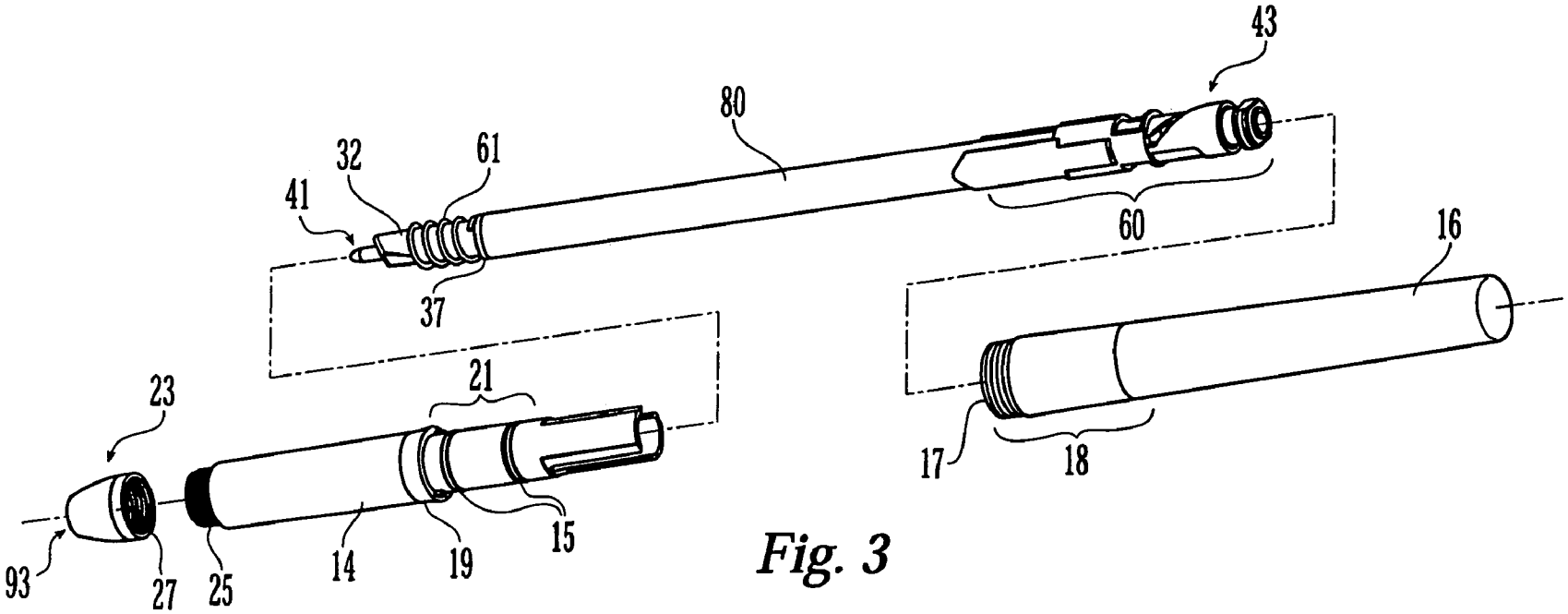
FIG. 3 is an exploded view of a writing instrument as in FIG. 1.

Referring now to FIG. 1, exemplary writing instrument 10 formed in accordance with the principles of the present invention, has an outer barrel 12 housing inner writing element 20 and outer writing element 22, such as illustrated in FIG. 2. It should be noted that the term "writing element" is not limited to a writing element in its literal sense but, instead, covers any element having any medium that can be applied to a substrate, including glue or correction fluid. Likewise, reference to "writing" or "marking," or other such terms, is made for the sake of convenience. The terms "writing" or "marking" are not limited to writing and marking in their literal sense but, instead should be understood to include application of other mediums or substrates such as glue or correction fluid. As illustrated in the embodiment of FIGS. 1 and 3, outer barrel 12 may comprise front barrel 14, back barrel 16, and front nose cone 23, extending, preferably, along longitudinal axis 11. Front and back barrels 14, 16 may be moveably coupled together for purposes as will become apparent. Front barrel 14 is positioned over writing elements 20, 22 at distal end 41, and back barrel 16 is positioned over writing elements 20, 22 at proximal end 43. Moreover, writing instrument 10 may have a grip (not shown) on front barrel 14, which may be made of, for example, soft rubberized paint or a separately formed elastomeric grip element.

Front and back barrels 14, 16 can be made of the same or different materials. For example, front barrel 14 can be made of ABS (acrylonitrile butadiene styrene) and back barrel 16 can be made of polypropylene. Various factors such as strength, ease of manufacturing, and ability to be decorated/painted (e.g., ability to receive rubberized paint to form a grip) may be considered in selecting the material that may be used for front barrel 14. Moreover, various factors such as resistance to vapor transmission or air-tightness (i.e., material chosen does not allow vapor/air to flow in or out of writing instrument 10), cost, ease of manufacturing, and lubricity (i.e., smoothness; minimal to no friction for ease of moving front and back barrels 14, 16 relative to each other) may be considered when selecting material that may be used for back barrel 16.

In one embodiment of the present invention, a portion of inner writing element 20 is provided with first writing tip 30 positioned outside outer barrel 12 and available for marking operations, and outer writing element 22 is moveable from a position with second writing tip 32 substantially entirely within outer barrel 12 to a position with second writing tip 32 outside outer barrel 12. In such a configuration, inner writing element 20 can be used to mark a surface. Conversely, in another embodiment, a portion of outer writing element 22 may be fixed and inner writing element 20 may be moveable from a position with writing tip 30 substantially entirely within outer barrel 12 to a position with writing tip 30 outside outer barrel 12. In yet another embodiment, both writing elements 20, 22 may be moveable from a position with a respective writing tip substantially entirely within outer barrel 12 to a position with a respective writing tip outside outer barrel 12.

Exemplary relative positioning and construction of writing elements 20, 22 may be appreciated with reference to FIG. 2, in which exemplary writing elements 20, 22 are shown co-axially mounted. This configuration, however, is not necessarily indicative of the position of writing elements 20, 22 within outer barrel 12. Inner writing element 20 has a smaller outer diameter dimension than inner axial passage 24 of outer writing element 22 so that inner writing element 20 can fit within inner axial passage 24 of outer writing element 20. Thus, as shown by arrow 26, writing elements 20, 22 are capable of axial movement with respect to each other.

Inner writing element 20 can be a highlighter, marker, ball point pen, roller ball pen, felt-tipped pen, fountain pen, or any other type of writing element using a fluid-based writing medium. In other embodiments, inner writing element 20 can be a pencil, stylus, chalk, charcoal, lead, or any other type of writing element using a solid-type writing medium. If desired, in order to limit the overall outer diameter of writing instrument 10, inner writing element 20 may be selected to have as small an outer diameter as possible. In such case, inner writing element 20 would generally not have a filler-type writing medium reservoir, as such reservoirs tend to occupy more space than a tube-type writing medium reservoir to hold a given amount of writing medium. For instance, any writing element utilizing a tubular reservoir for holding writing medium, or any solid-type writing medium may be used to keep the overall diameter of writing instrument 10 as close to that of a standard single-writing-element writing instrument. Preferably, such writing element is rigid or semi-rigid for purposes as will become apparent. For the sake of convenience, such writing elements are referenced herein as "structurally stable thin writing elements," in contrast with filler-type writing elements utilizing filler-type writing medium reservoirs and the like that result in bulky writing elements that cause an overall increase in the outer diameter of writing instrument 10 upon insertion within outer writing element 22. As used herein, a filler-type writing medium reservoir is a writing medium reservoir that contains porous material (made of polymers (natural or synthetic), ceramics, metals, or the like) for holding a writing medium (such as within its pores) without allowing the writing medium to flow freely, yet allowing the writing medium to be extracted (such as by a wick using capillary forces) for application to a surface as desired. The pores can be formed in any of a variety of ways—such as by blow molding, by sintering, or by fiber bundling. It will be appreciated that these examples of writing elements are merely illustrative and the present invention is not necessarily limited thereto. It will further be appreciated that the term "writing medium" is used for the sake of convenience and is not intended to limit the "writing element" to specifically "writing" operations, as the invention is not limited to "writing" operations, as noted above.

In the embodiment of FIG. 2, inner writing element 20 is formed from two distinct members—first writing tip 30 and first writing medium reservoir 28. It should be appreciated, however, that writing tip 30 and first writing medium reservoir 28 can be one unitary, monolithic piece. In a preferred embodiment, first writing tip 30 of inner writing element 20 is in direct operative contact with first writing medium reservoir 28 when a fluid-based writing medium is used.

First writing medium reservoir 28 can be a writing medium tube or ink tube (i.e., hollow tube capable of holding ink), such as those known in the art. Unlike a filler-type writing medium reservoir, which is also generally known in the art, the writing medium tube has no filler material for holding writing medium. Nonetheless, the first writing medium reservoir 28 can also be a filler-type writing medium reservoir (not shown) —e.g., filler material saturated with marking medium.

In one embodiment, outer writing element 22 has two distinct members—second writing tip 32 and second writing medium reservoir 34. Moreover, second writing tip 32 may be in direct operative contact with second writing medium reservoir 34. It should be noted that second writing tip 32 and second writing medium reservoir 34 can be one unitary piece instead. In the embodiment of FIG. 2, outer writing element 22 has an inner axial passage 24 therethrough—preferably through second writing tip 32 and second writing medium reservoir 34. To facilitate insertion of inner writing element 20 through outer writing element 22, second writing medium reservoir 34 preferably is a filler-type reservoir having a filler material (not shown) for holding writing medium. The filler may be made of a material such as polyester, acrylic, acetate, and may have a porosity of approximately 80% and a fiber density of approximately 0.18 gr/cm$^3$. The porosity, however, can be as low as approximately 75% or can be as high as approximately 95%, and the fiber density can be as low as approximately 0.16 gr/cm$^3$ or as high as approximately 0.2 gr/cm$^3$. Specifically, the filler may comprise polyester, acrylic, or acetate fibers—such as available from De Martini SPA (Via Santuario d'Oropa, Italy) or Filtrona (London, England)—or a bicomponent fiber (e.g., containing both polypropylene and polyethylene), such as available from Filtrona. Various factors such as cost, density, porosity, chemical stability, amount of time for the filler material to dry out, and ease of manufacturing may be considered when selecting materials that may be used for the filler. Second writing medium reservoir 34 may, however, also be filler-less—similar to a writing medium tube. In one embodiment, the outer writing element can be a highlighter or marker. But, other writing elements may be used instead.

Second writing tip 32 preferably is formed and configured to have a wall thickness thick enough to permit formation of an inner axial passage 24 therethrough without collapsing during writing. Also, second writing tip 32 should be formed so that a consistent line may be drawn each time it is used.

Preferably, second writing tip 32 may be a porous nib. As used herein, a "porous nib" is a deflection-resistant porous application tip that is typically rod-shaped, with a pointed or chiseled free end, and that delivers writing medium from a reservoir to a surface (e.g., paper), typically by capillary action. The porous nib may be formed from any desired porous material, such as polymers (natural or synthetic) or ceramics, using conventional forming processes such as sintering, blow molding, extrusion, fiber bundling, or the like. Such porous nib is thus distinguished from solid-type writing mediums (as defined above) and other non-porous nibs, such as fountain pen nibs, roller-ball points, and ball-points, or other such writing tips or nibs in which the writing medium flows over or around the exterior of the writing tip and onto the application substrate. A porous nib-type element may include, but is not limited to, highlighter, marker, or felt-tipped nibs. Such porous nibs are typically relatively wider than other writing tips, and are not used for fine, detailed writing, and may be chiseled to permit marking of wide lines. As a porous nib, second writing tip 32 may be made of, for example, sintered polyethylene powder or polyester fibers, having a porosity of approximately 50%, such as sold by Porex Products, of Fairburn, Ga. The porous nib can also be made of acrylic or polyamide (e.g., Nylon) fibers having a porosity of approximately 60%; however, a porosity as low as approximately 50% or as high as approximately 70% may also be used. A polyester fiber porous nib, such as sold by Teibow or Aubex (both of Japan) may be used, instead, to provide a potentially longer cap-off time (i.e., allowing reduction in evaporation of writing medium). The fiber density of the porous nib can be as low as approximately 0.1 gr/cm$^3$ or as high as approximately 0.3 gr/cm$^3$. Moreover, the density may vary, if desired, along the longitudinal axis. For instance, a higher density at the writing end may be desirable to prevent wobble. It should be noted, however, that while a lower density may be better for immediate ink flow (i.e., the initial ink flow at about the time the writing element contacts a writing surface), it is not necessarily better for total ink flow (i.e., the ink flow over the entire time the writing element is in use). Nevertheless, both wobble and ink flow can be taken into consideration when deciding on the density of the nib material. Moreover, various factors, such as cost, strength, rigidity, density, porosity, chemical stability (e.g., resistance to corrosion or break-down of writing medium or components in contact with writing medium), amount of time for the nib material to dry out, and ease of manufacturing may be considered when selecting materials that may be used for the porous nib.

Figure 5:
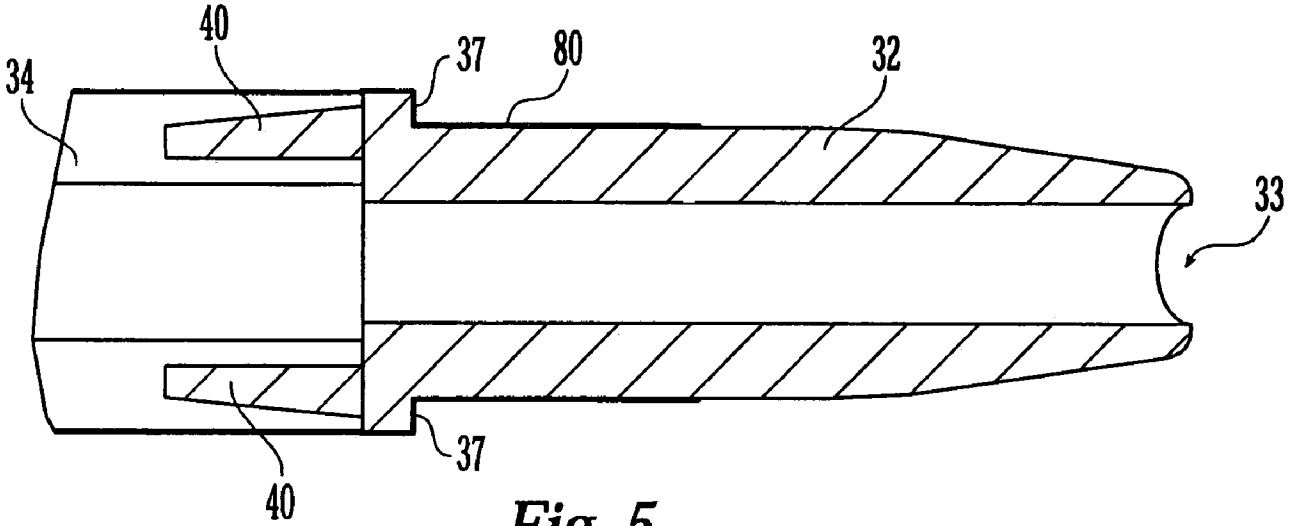
FIG. 5 is a longitudinal cross-sectional view of an exemplary porous nib for an outer writing element in accordance with the principles of the present invention.
Figure 6:
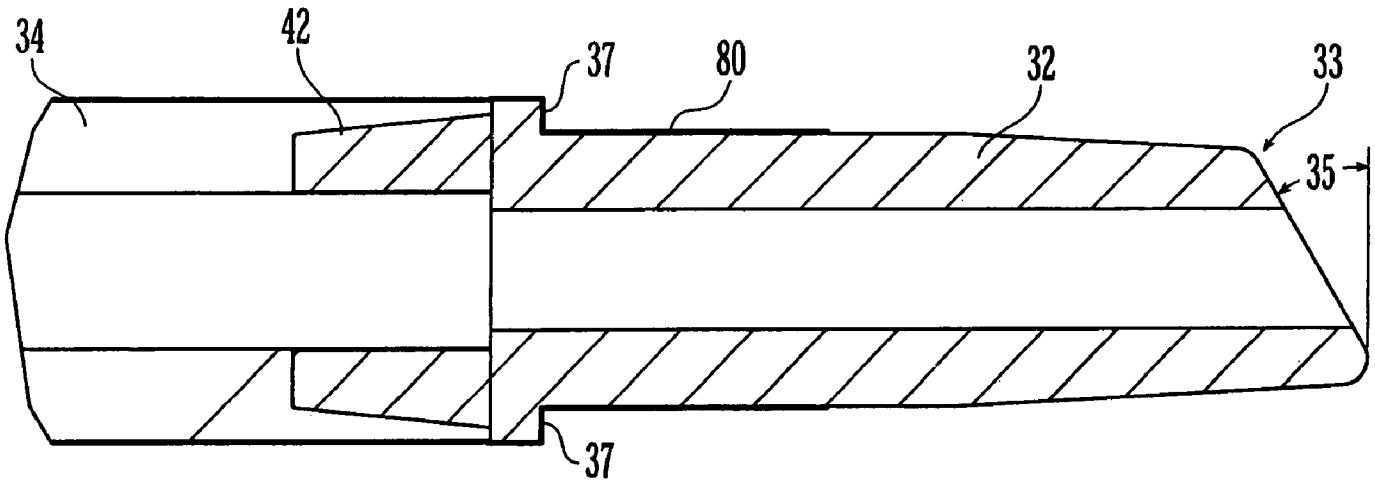
FIG. 6 is another longitudinal cross-sectional view of an exemplary porous nib for an outer writing element in accordance with the principles of the present invention.

As illustrated in both FIGS. 5 and 6, distal porous nib portion 33 may have different profiles. For example, distal porous nib portion 33 can be angular or straight. The angle 35 between a writing surface (not shown) and distal porous nib portion 33 is known as the angle of the chisel, which can be any angle typically approximately more than 0° or typically approximately less than 90° (0° forming a straight distal porous nib portion 33, as illustrated in FIG. 5, and 90° forming a flat distal porous nib portion (not shown)). A preferred exemplary angle of distal porous nib portion 33 is approximately 30°. Moreover, second writing tip 32 may have a cross-section that is round, square, conical, frustro-conical, etc. Such profiles and cross-sections are only illustrative and do not limit the range of possible profiles and/or cross-sections. Preferably, distal porous nib portion 33 is shaped and configured (e.g., by selecting an appropriate angle and thickness) to permit uniform marking without a "railroad" effect such as two lines with no marking therebetween.

As shown in FIGS. 5 and 6, second writing tip 32 can have various connection components. For example, second writing tip 32 may have one or more prongs 40 extending therefrom to engage second writing medium reservoir 34. In another embodiment, second writing tip 32 may use open-ended cylinder 42 for engaging second writing medium reservoir 34.

Figure 8:
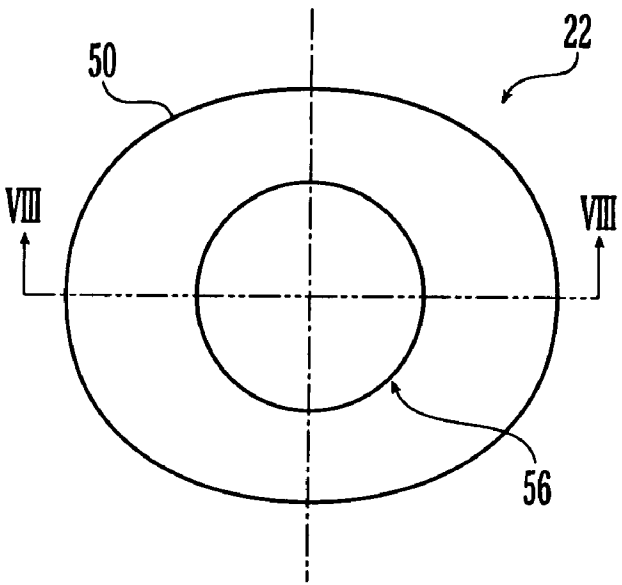
FIG. 8 is a cross-sectional view of another exemplary outer writing element along line VIII—VIII of FIG. 2.
Figure 7:
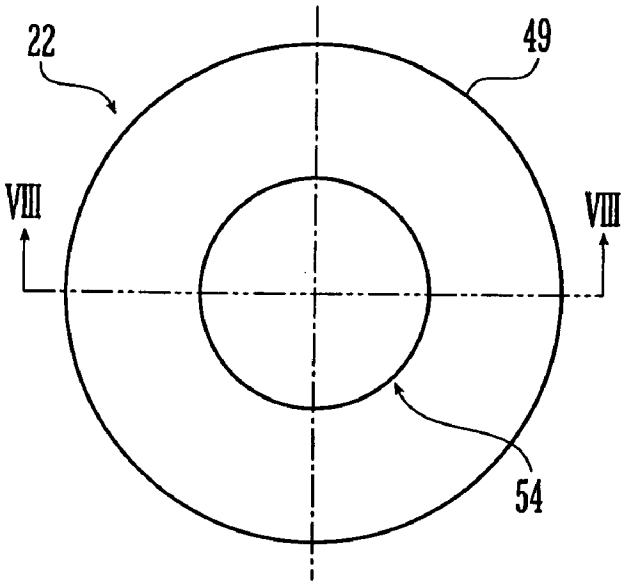
FIG. 7 is a cross-sectional view of an exemplary outer writing element in accordance with the principles of the present invention.

In the embodiments, shown in FIGS. 7 and 8, at least a portion of outer writing element 22 may have a circular cross-section 49 or non-circular (e.g., oval) cross-section 50, and inner diameter 54, 56 (respectively) of outer writing element 22 has a circular cross-section. In another embodiment, not shown, at least a portion of inner writing element 20 may have a non-circular (e.g., oval) cross-section. The cross-section of outer writing element 22 may be selected to provide improved resistance to flexure or wobble (i.e., the bend of a writing element that occurs during writing) as compared to a writing element with an inner axial passage and a circular cross-section. A circular inner diameter 54, 56 allows for ease in axial movement of writing elements 20, 22 with respect to each other. Nevertheless, in another embodiment, inner diameter 54, 56 may be oval or another shape.

While one reservoir can be used to supply writing medium to both writing elements 20, 22, it is desirable for second writing medium reservoir 34 to be separate and distinct from first writing medium reservoir 28. In this way, reservoirs 28, 34 can contain different writing mediums or exhibit different characteristics, such as different colors.

It should be noted that first and second writing medium reservoirs 28, 34 may be selected to have a writing capacity not significantly lower than that of a writing instrument with a single writing element having the same type of writing medium reservoir. For example, if inner writing element 20 is a ball point pen and outer writing element 22 is a highlighter, inner writing element 20 and outer writing element 22 preferably have the same writing capacity as a standard ball-point and a standard highlighter, respectively. A ballpoint pen according to current industry standards can draw a line approximately 1800 meters in length; a highlighter according to current industry standards can draw a line approximately 120 meters in length. Because outer writing element 22 loses valuable space to inner axial passage 24, such a requirement affects the maximum desirable outer diameter of outer writing element 22, and consequently, the maximum desirable outer diameter of writing instrument 10. The writing capacity may be optimized while keeping the reservoirs within the desired size limitations by manipulating various factors, such as the combination of materials making up the outer writing element, the wall thicknesses of the elements, and overall dimensions of the pen. Based on average usage of ball point pen and highlighters, a writing capacity ratio of approximately 10:1 is desirable—i.e., preferably, writing instrument 10 provides approximately 10 meters of ball point pen line for every approximately 1 meter of highlighter line. It will be appreciated that the desired reservoir capacity may be affected by the desired outer diameter and/or length of the finished writing instrument, and other such factors appreciated by those of skill in the art.

In order to operate writing instrument 10, it is desirable to have a driving mechanism operatively connected to at least one writing element 20, 22 for moving the at least one writing element 20, 22 with respect to the other writing element 20, 22. The driving mechanism can be actuated by moving at least a portion of or another component coupled to the driving mechanism. Upon actuation of the driving mechanism, a desired writing element is extended into a use position. Such driving mechanism may be actuated by twisting (i.e., a twist-actuated driving mechanism) a portion of writing instrument 10 or an element connected thereto, or by pushing a pushbutton actuator axially along the longitudinal axis of writing instrument 10.

Figure 9:
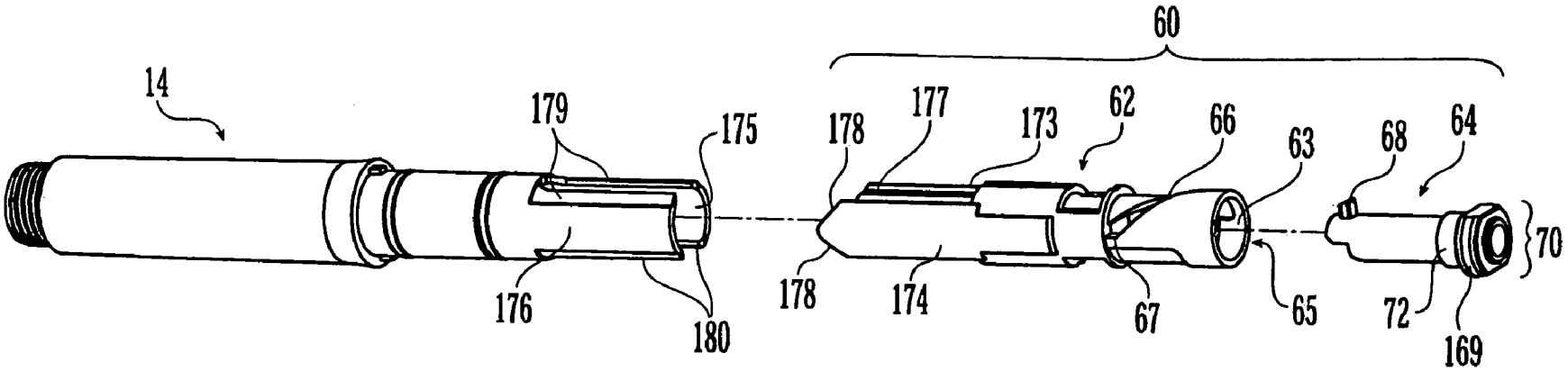
FIG. 9 is an exploded view of an embodiment of a front barrel engaging an exemplary driving mechanism of a writing instrument formed in accordance with the principles of the present invention.

One exemplary driving mechanism 60 is illustrated in FIG. 9. Driving mechanism 60 includes two driving components—a mobile, female cam 62 and an axially stationary male cam 64. It will be appreciated that interactions of various components of driving mechanism 60 with respect to components of writing instrument 10 are applicable to other driving mechanism embodiments described herein. Mobile cam 62 can be made of polyamide (e.g., Nylon) or polyacetal (e.g., Delrin), and male cam 64 can be made of polyacetal (e.g., Delrin). However, other materials can be used to make mobile cam 62 and male cam 64. Various factors such as strength, rigidity, and lubricity (i.e., smoothness) may be considered when selecting materials that may be used for cams 62 and 64. In general, one writing element 20, 22 may be coupled to mobile cam 62 and the other writing element 20, 22 can be coupled to male cam 64, as described in further detail below. Male cam 64 can be inserted in bore 63 at proximal end 65 of mobile cam 62. While other methods of insertion are possible, in the illustrated configuration of cams 62, 64, insertion may be accomplished by inserting male cam 64 into bore 63 at an angle (e.g., approximately 35° to approximately 45°) and then straightening male cam 64 as it is further inserted into mobile cam 62. Male cam 64 has pin 68, which can be fitted into helical cam slot 66 of mobile cam 62.

In one embodiment of the present invention, driving mechanism 60 operates to move outer writing element 22 with respect to inner writing element 20. Inner writing element 20 may be fixed with respect to outer barrel 12, or may be arranged for axial movement as well. In such embodiment, outer writing element 22 can be operatively coupled to mobile cam 62 and inner writing element 20 may be coupled to male cam 64 or outer barrel 12. Outer writing element 22 can be held by longitudinal ribs (not shown) in mobile cam 62. For example, if outer writing element 22 comprises a filler-type writing medium reservoir, the longitudinal ribs can cut into the filler-type writing medium reservoir and/or filler material. Proximal end 73 (FIG. 2) of inner writing element 20 can be inserted into a bore (not shown) in male cam 64 or may be coupled to outer barrel 12 in another manner to permit axial movement with respect to outer writing element 22. Inner writing element 20 may be arranged in male cam 64 so that proximal end 73 of inner writing element 20 does not extend past male cam 64.

Furthermore, an optional biasing element, such as a coil spring 61 (FIG. 3), can be positioned around second writing tip 32 between shoulder 37 (FIGS. 3, 5 and 6) of second writing tip 32 and front nose cone 23. Thus, outer writing element 22 can be pushed back into mobile cam 62. It will be appreciated that when outer writing element 22 is extended into a writing or marking position, spring 61 is compressed. When compressed, spring 61 essentially functions as an outer tubular support for second writing tip 32. The provision of a spring thus adds structural stability to second writing tip 32, and thereby further addresses the desire to assure that a hollow writing tip 32 is sufficiently structurally stable to write or mark effectively. Moreover, by pressing outer writing element 22 into mobile cam 62, spring 61 inhibits if not prevents loosening and/or separation of outer writing element 22 and mobile cam 62 if, for example, writing instrument 10 is impacted, such as by falling/dropping and outer writing element 22 hits a surface (e.g., a floor, table, etc.). Various factors such as strength and chemical stability can be considered when selecting the material to be used for spring 61. For instance, spring 61 can be made of 316 stainless steel or any other suitable material. Moreover, spring 61 should be flexible enough to allow for operation of driving mechanism 60, while being strong enough to hold outer writing element 22 in mobile cam 62. Additionally, there may an O-ring (not shown) around second writing tip 32 between second writing tip 32 and front nose cone 23. Such a construction could prevent/reduce the evaporation of writing medium.

Figure 4:
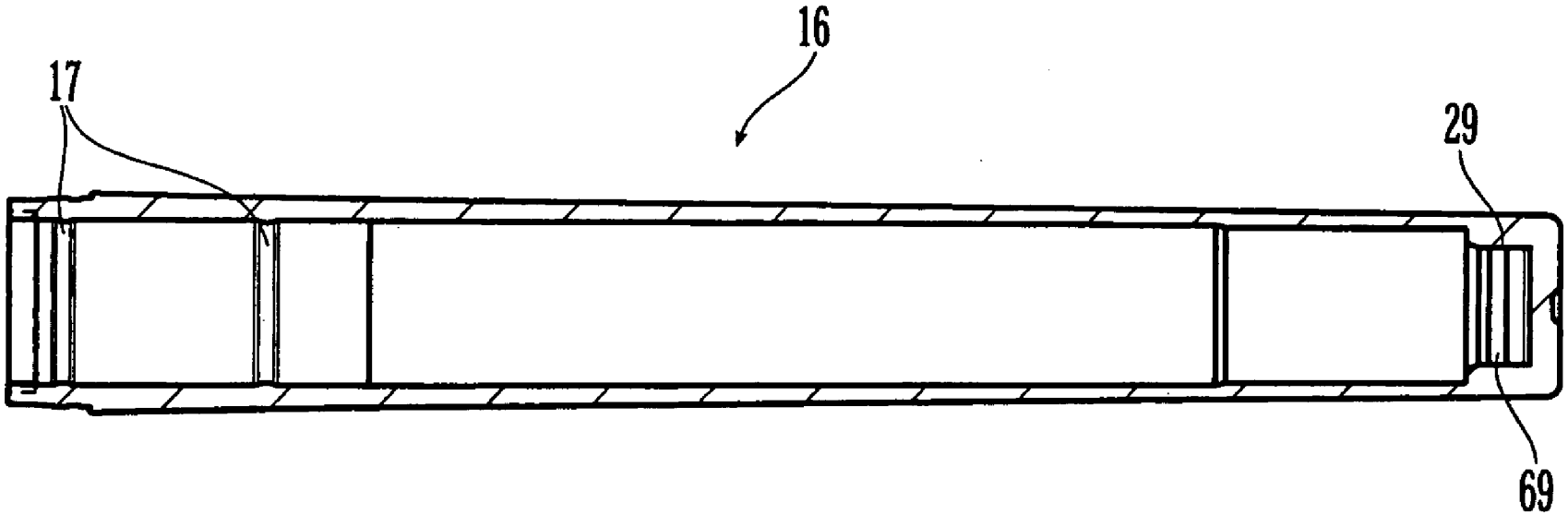
FIG. 4 is a longitudinal cross-sectional view of the back barrel of a writing instrument as in FIG. 1.
Figure 16:
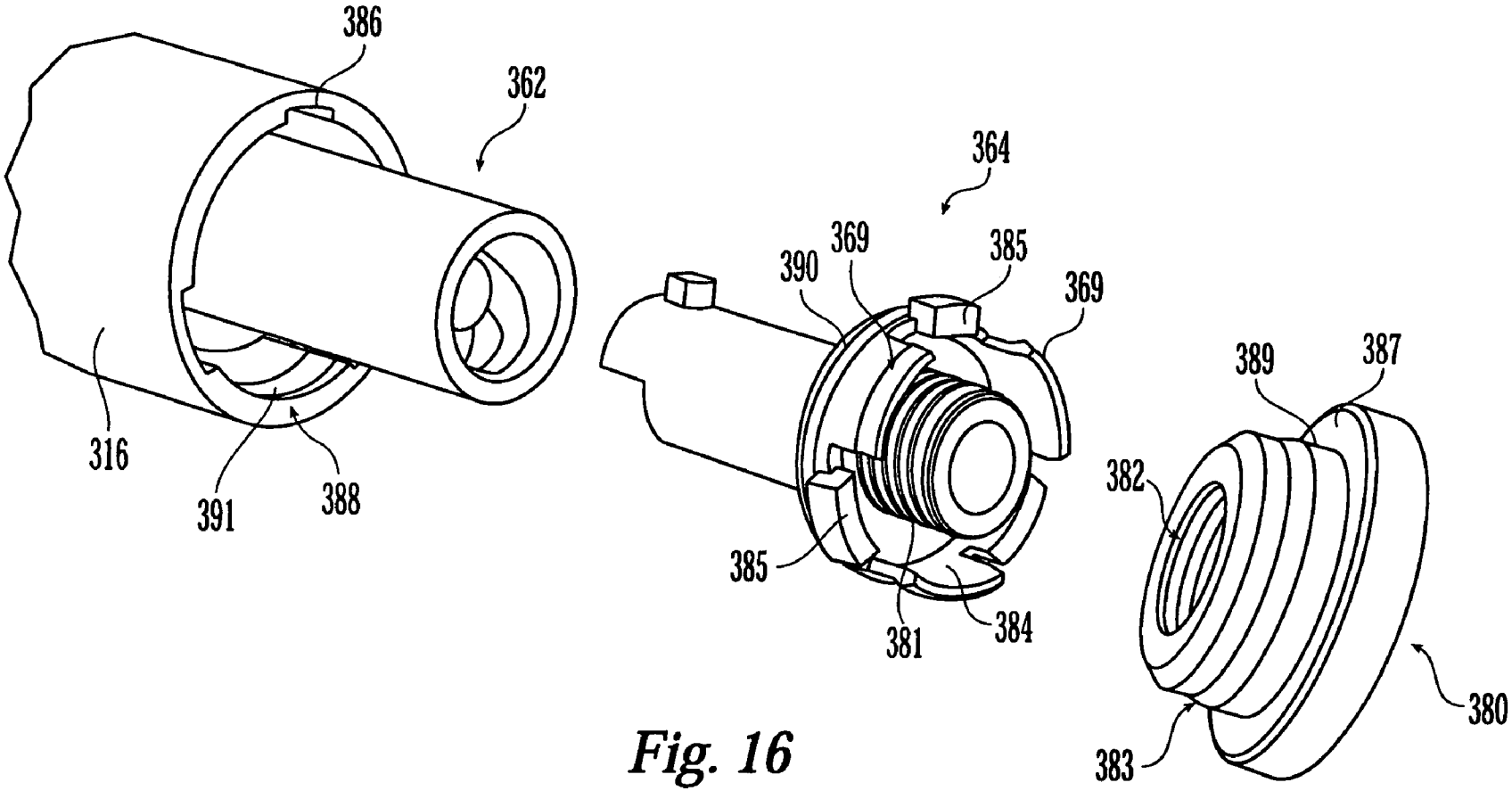
FIG. 16 is an exploded view of the components of an exemplary replacement mechanism.

In one embodiment, male cam 64 may be fixed to back barrel 16 so that rotation of back barrel 16 causes rotation of male cam 64 (preferably generally corresponding to the rotation of back barrel 16) without causing axial movement of male cam 64. While male cam 64 can be fixed to back barrel 16 in numerous ways, in the embodiment of FIG. 9, insertion member 70 can be press-fitted into inner receiving member 29 (FIG. 4). Engaging flats 169 may be provided on male cam 64 to engage back barrel receiving flats 69 (FIG. 4). As described in greater detail below, FIG. 16 illustrates another embodiment in which a male cam 364 is fixed to back barrel 316 by engaging protrusions 385 in notches 386, and by engaging flats 369 in back barrel receiving flats 391. Mobile cam 62, 362 is free to move with respect to back barrel 16, 316. Mobile cam 62, 362 is also free to move axially, but not rotationally, with respect to front barrel 14 to extend or to retract a writing element 20, 22.

In operation, in the embodiment of FIGS. 3 and 9, rotation of back barrel 16 (or any other component coupled to driving mechanism 60) causes rotation of male cam 64 (preferably generally corresponding to the rotation of back barrel 16) and, consequently, rotation of pin 68 in cam slot 66. Because mobile cam 62 is fixed against rotational movement, rotation of pin 68 in cam slot 66 results in axial movement of mobile cam 62, and corresponding axial movement of one writing element 20, 22 with respect to the other writing element 20, 22. Thus, if mobile cam 62 and male cam 64 are moved axially with respect to each other, the writing elements 20, 22 respectively coupled thereto also move axially with respect to each other. Cam slot 66 may terminate in locking notches 67 or the like, in which pin 68 may be disposed to prevent further rotation of male cam 64. Locking notches 67 are extensions of cam slot 66 extending substantially perpendicular to longitudinal axis 11 (FIG. 1). Thus, locking notches 67 may retain moveable writing element 20, 22 in an extended or a retracted position. Male cam 64 also may have a radially outwardly extending stopping section, such as in the form of stopping element 72, which effectively increases the outer diameter of male cam 64, thereby preventing male cam 64 from moving too far into mobile cam 62 once proximal end 65 contacts the stopping element 72. However, it is possible that pin 68 might reach the end of slot 66 at substantially the same time that stopping element 72 contacts mobile cam 62. When pin 68 reaches the end of slot 66 or stopping element 72 contacts proximal end 65 of mobile cam 62, back barrel 16 can be turned no further, so that the writing element 20, 22 that is being moved is fully extended and its distal end extends beyond (or in the same plane as, if desired) the distal end of the fixed writing element 20, 22.

To enable movement of inner and outer writing elements 20, 22 with respect to each other, driving mechanism 60 may be moveably coupled to front barrel 14. As shown in FIG. 9, mobile cam 62 may have two prongs 173, 174, which engage corresponding front barrel prongs 175, 176, such that mobile cam 62 can move axially, but not rotationally, with respect to front barrel 14. Prongs 173, 174 and 175, 176 may be made of the same material as cam 62 and front barrel 14, respectively. Various factors such as rigidity, strength, and ease of manufacturing may be considered when selecting material to be used for prongs 173, 174, 175, and 176. It will be appreciated that other numbers and configurations of prongs are within the scope of the invention. For example, mobile cam 62 may have a single prong engaging a single prong receiving structure (not shown) of front barrel 14. Alternatively, front barrel 14 may have a single prong engaging a single prong receiving structure (not shown) of mobile cam 62. Moreover, for the driving means 60 illustrated in FIG. 9, any means of attaching mobile cam 62 to front barrel 14 may be used. Preferably, the configuration of the driving mechanism at least allows movement of mobile cam 62 along the axis of front barrel 14.

In the embodiment of FIG. 9, prongs 173, 174 on mobile cam 62 can be provided with guides 177, 178, respectively. Rail members 179, 180 are provided on front barrel 14, such as on barrel prongs 175, 176. Guides 177 may engage rail members 179 and guides 178 may engage rail members 180 such that mobile cam 62 can move axially, but not rotationally, with respect to front barrel 14. Upon rotation of back barrel 16, male cam 64 rotates to move mobile cam 62 axially with respect to front barrel 14 in a distal or proximal direction. Consequently, guides 177, 178 move along rail members 179, 180. Prongs 173, 174, 175, and 176 can be positioned between second writing medium reservoir 34 (e.g., filler-type writing medium reservoir) and outer barrel 12. Thus, prongs 173, 174 and 175, 176 will not disengage from one another and possibly break. It will be appreciated that configurations of mating elements other than those illustrated, but formed to effect movement of mobile cam 62, are within the scope of the present invention.

Figure 10:
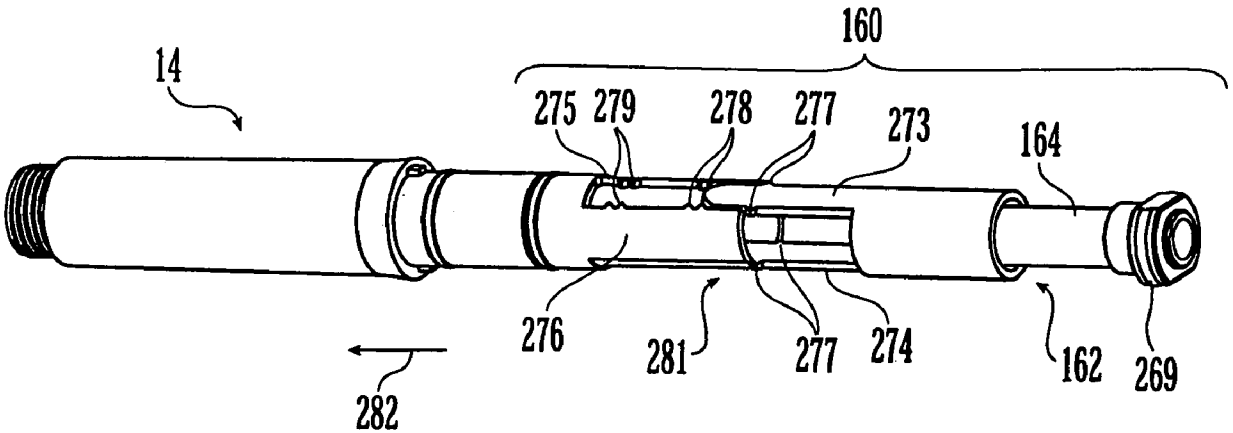
FIG. 10 is a perspective view of another embodiment of a front barrel engaging a second exemplary driving mechanism of a writing instrument formed in accordance with the principles of the present invention.

FIG. 10 illustrates an alternative prong mechanism. Driving mechanism 160 of FIG. 10 is similar to driving mechanism 60 of FIG. 9. As shown in FIG. 10, mobile cam 162 may have two prongs 273, 274, which engage corresponding front barrel prongs 275, 276, such that mobile cam 162 can move axially, but not rotationally, with respect to front barrel 14. Prongs 273, 274 and 275, 276 may be made of the same material as cam 162 and front barrel 14, respectively.

Various factors such as rigidity, strength, and ease of manufacturing may be considered when selecting material to be used for prongs 273, 274, 275, and 276. The material used for prongs 273, 274, 275, and 276, however, preferably are not brittle.

If desired, engaging elements may be provided to regulate the extent of axial movement of mobile cam 162. Such engaging elements may be used, for instance, to prevent over-extension of mobile cam 162. In the embodiment of FIG. 10, at least one of prongs 273, 274 on mobile cam 162 may be provided with protrusions 277, and front barrel 14 may be provided with receiving members 278, 279, such as on barrel prongs 275, 276. In the retracted position of mobile cam 162, protrusions 277 engage first group of receiving members 278 at a proximal end 281 of front barrel prongs 275, 276. Upon rotation of back barrel 16, male cam 164 rotates to move mobile cam 162 axially with respect to front barrel 14 in a distal direction 282. Consequently, protrusions 277 disengage first group of receiving members 278 and, once mobile cam 162 has moved axially to extend one of writing elements 20, 22, protrusions 277 engage second group of receiving members 279. Such engagement stops further extension of the at least one writing element 20, 22 beyond the other writing element 20, 22. It will be appreciated that configurations of engaging elements other than those illustrated, but formed to effect movement of mobile cam 162, are within the scope of the present invention.

Figure 11:
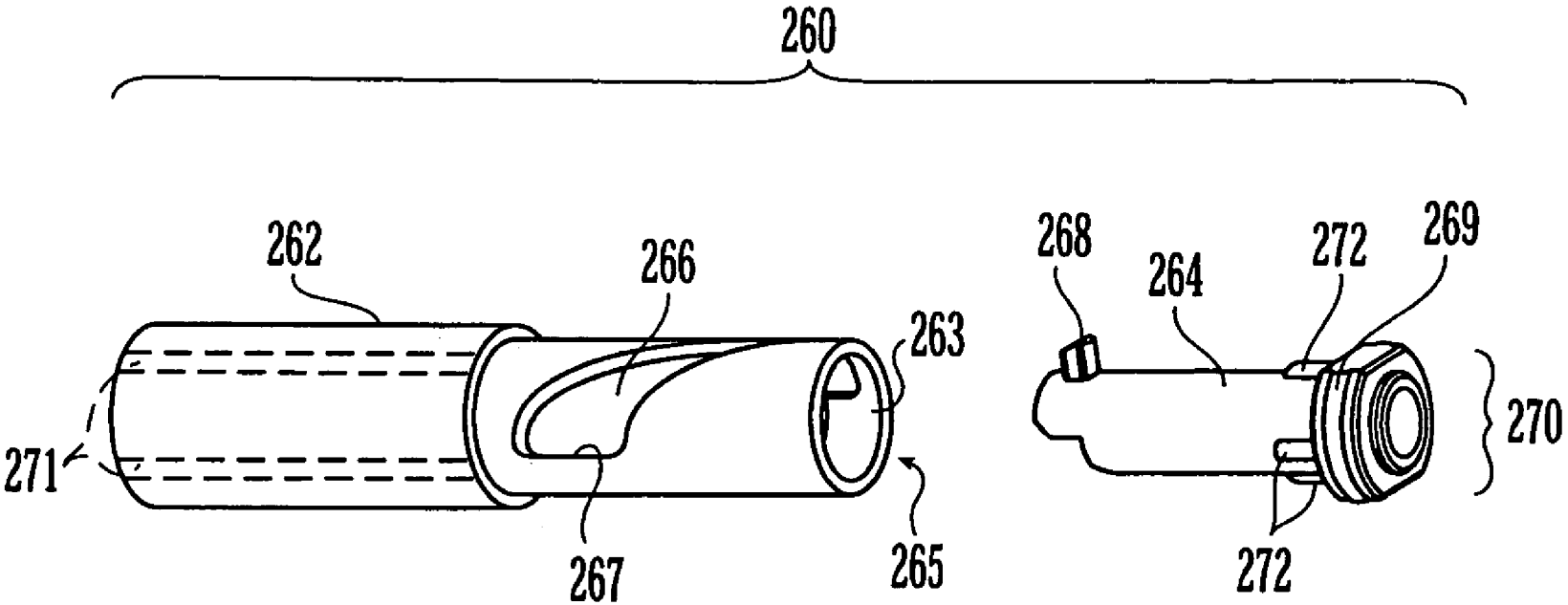
FIG. 11 is an exploded alternative view of components making up a third embodiment of a driving mechanism of a writing instrument.

In an alternative embodiment illustrated in FIG. 11, exemplary driving mechanism 260 includes a mobile, female cam 262 and male cam 264. Driving mechanism 260 may work much like driving mechanism 60 or 160 to accomplish a similar result. Male cam 264 can be inserted in bore 263 at proximal end 265 of mobile cam 262. While other methods of insertion are within the scope of the present invention, insertion may be accomplished by inserting male cam 264 at an angle (e.g., approximately 35° to approximately 45°) with respect to female cam 262 and then straightening male cam 264 as it is further inserted into female cam 262. Male cam 264 has pin 268 that can be fitted into helical cam slot 266 of mobile cam 262. Cam slot 266 may terminate in locking notches 267 (similar to above-described locking notches 67) or the like, in which pin 268 may be disposed to prevent further relative rotation of male cam 264 and mobile cam 262 and to prevent further axial movement of mobile cam 262. This may provide a means of locking a moveable writing element 20, 22 into an extended or retracted position. Male cam 264 also may have a stopping section, such as in the form of stopping ribs 272, which effectively increase the outer diameter of male cam 264, thereby preventing male cam 264 from moving into mobile cam 262 once proximal end 265 contacts stopping ribs 272. However, it is possible that pin 268 might reach the end of slot 266 at substantially the same time that stopping ribs 272 contact mobile cam 262. While male cam 264 can be fixed to back barrel 16 in numerous ways, insertion member 270 can be press-fitted into inner receiving member 29 (FIG. 4). Engaging flats 269 may also be provided on male cam 264 to engage back barrel receiving flats 69 (FIG. 4) to fix male cam 264 to back barrel 16.

In one embodiment of the present invention, driving mechanism 260 operates to move outer writing element 22 with respect to inner writing element 20. Inner writing element 20 may be fixed with respect to outer barrel 12, or may be arranged for axial movement as well. In such embodiment, outer writing element 22 can be operatively coupled to mobile cam 262 and inner writing element 20 may be operatively coupled to male cam 264 or outer barrel 12. Outer writing element 22 can be held in mobile cam 262 by longitudinal ribs 271 (shown in phantom in FIG. 11). For example, if outer writing element 22 comprises a filler-type writing medium reservoir, ribs 271 can cut into the filler-type writing medium reservoir and/or filler material. Proximal end 73 (FIG. 2) of inner writing element 20 can be inserted into a bore (not shown) in male cam 264 or may be operatively coupled to outer barrel 12 in another manner to permit axial movement with respect to outer writing element 22. Inner writing element 20 may be arranged in male cam 264 so that proximal end 73 of inner writing element 20 does not extend past male cam 264.

To enable movement of inner and outer writing instruments 20, 22 with respect to each other, driving mechanism 260 may be moveably coupled to front barrel 14. For example, non-circular cross-section 50 (e.g., oval) (FIG. 8) of outer writing element 22 may contact outer barrel 12. Cross-section 50 would allow for axial, but not rotational movement of mobile cam 262 and outer writing element 22 in an embodiment where the inner surface of front barrel 12 has a non-circular cross-section as well. It should be noted, however, that any other manner of preventing rotation of mobile cam 262 with respect to front barrel 14 may be implemented as well. Thus, rotation of back barrel 16 (or a portion of outer barrel 12 connected to driving mechanism 260) rotates male cam 264, causing pin 268 to move in slot 266 in a helical direction. Even though mobile cam 262 may be constrained against rotational movement, mobile cam 262 can still move axially. This results in axial movement of writing elements 20, 22 with respect to each other.

Figure 12:
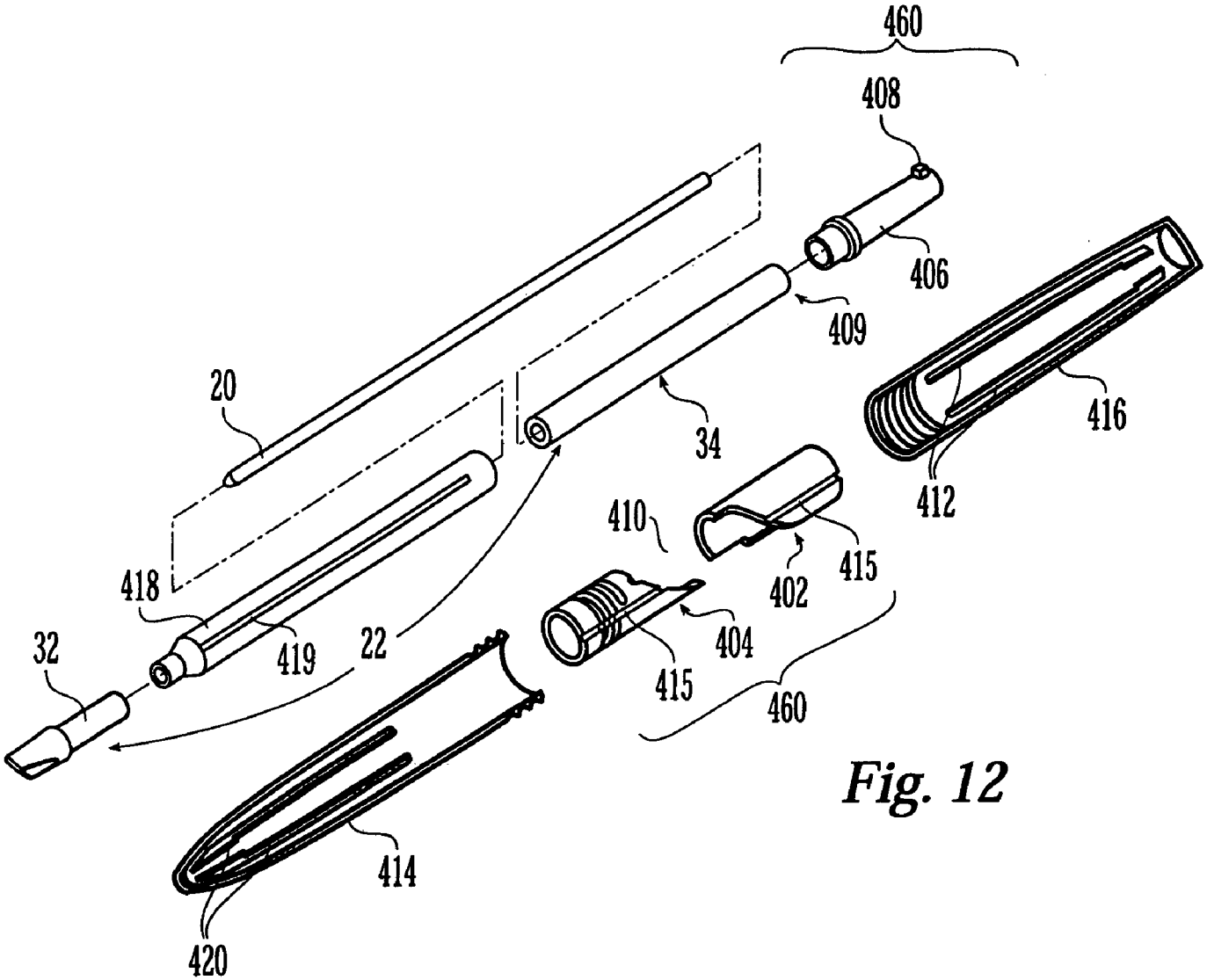
FIG. 12 is an exploded view of an exemplary drive mechanism and writing instrument.

FIG. 12 shows another embodiment of a driving mechanism 460 with exemplary writing elements 20, 22. Driving mechanism 460 is made up of cam 402, counter-cam 404, and cartridge closure 406 having cam follower 408 preferably formed thereon. While cam 402 and counter-cam 404 are shown as two separate pieces, it should be noted that they can be a single, composite piece. Cam 402 and counter-cam 404 may be formed as a single piece hinged together, thus allowing cam 402 and counter-cam 404 to open like a clam shell. Cartridge closure 406 with cam follower 408 are inserted over proximal end 409 of outer writing element 22, and may be in the form of a clam shell to facilitate such insertion. Cam 402 and/or counter-cam 404 can be closed around cartridge closure 406. Specifically, cam follower 408 can be inserted in helical camming slot 410 (i.e., the space between cam 402 and counter-cam 404). Alternatively, cartridge closure 406 and cam follower 408 may be force-fitted into cam 402 and/or counter-cam 404.

Cam 402, counter-cam 404, and inner writing element 20 may be fixed against axial and rotational movement with respect to back barrel 416. As shown in FIG. 12, fixing of cam 402 and counter-cam 404 can be accomplished by the mating of longitudinal back ribs 412 in back barrel 416 and cam grooves 415 in cam 402 and counter-cam 404. Outer writing element 22 is free to move axially, but not rotationally, along longitudinal front ribs 420. Since cartridge closure 406 with cam follower 408 may be fixed to outer writing element 22, it may also be free to move axially.

The embodiment of FIG. 12 can also have a cartridge case 418 for guiding the movement of outer writing element 22. Cartridge case 418 may be made from polypropylene, polyethylene, nylon, or any other suitable material. Cartridge case 418 may have grooves 419 receiving longitudinal front ribs 420 of front barrel 414. Rotation of back barrel 416 (or any portion of outer barrel 12 connected to driving mechanism 460) rotates cam 402 and counter-cam 404, which, in turn, causes cam follower 408 to move along camming slot 410. The movement of cam follower 408 translates to axial movement of cartridge closure 406. Thus, while inner writing element 20 remains stationary, outer writing element 22 moves axially with respect thereto. Grooves 419 guide axial movement of outer writing element 22 by groove 419 moving along longitudinal front ribs 420.

Figure 13:
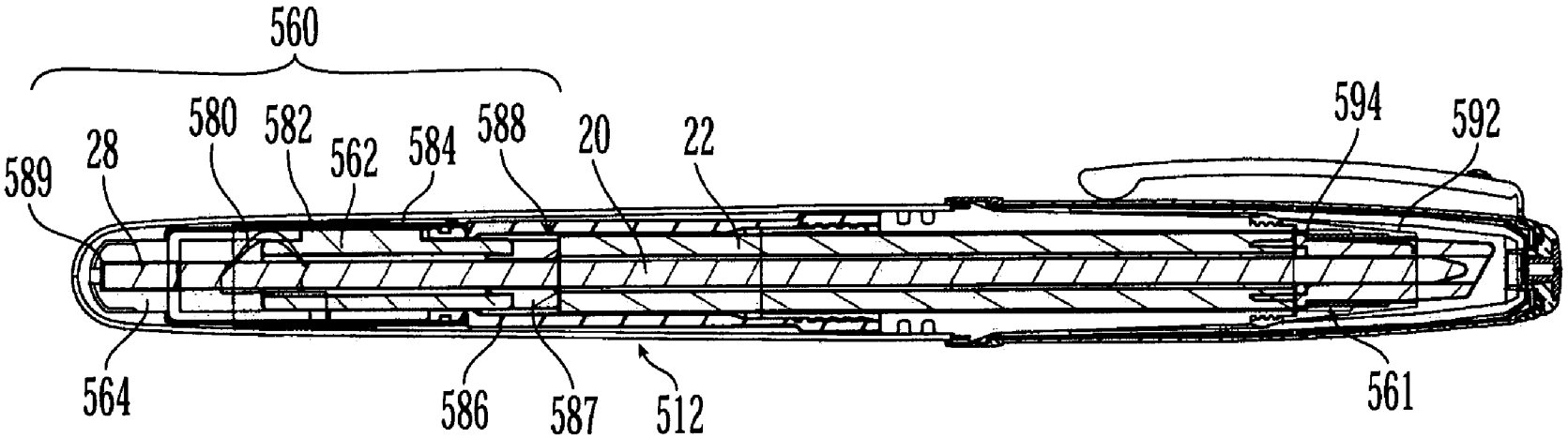
FIG. 13 is a cross-sectional view of an exemplary writing instrument with another embodiment of a drive mechanism.

Yet another exemplary driving mechanism 560 is illustrated in FIG. 13. Driving mechanism 560 may be positioned in outer barrel 512. Driving mechanism 560 includes a stationary cam 564 in the form of a spinner with a helical cam surface 580 (similar to those used in twist-actuated retractable writing instruments), and mobile cam 562 in the form of a follower having a cam follower protrusion 582 that rides along helical cam surface 580. Cam follower protrusion 582 is fixed against rotational movement with respect to outer barrel 512 by being held within a slit 584 in bushing 586 in which mobile cam 562 is positioned. Thus, rotation of outer barrel 512 causes rotation of stationary cam 564 which, in turn, causes cam follower protrusion 582 to ride along helical cam surface 580 and thus to move axially along slit 584. A writing element 20, 22 rests against a plug 587 at distal end 588 of mobile cam 562 and is thereby retracted or extended as stationary cam 564 is rotated. In the embodiment of FIG. 13, stationary cam 564 is different from prior art spinners in that a recess 589 is formed therein to hold inner writing element 20 (and, more specifically, first writing medium reservoir 28). Outer writing element 22 abuts plug 587 to move axially therewith with axial movement of mobile cam 562. A spring 561, which is positioned between front nose cone 592 and shoulder 594 of outer writing element 22, pushes outer writing element 22 against plug 587 (i.e., spring 561 keeps plug 587 in continuous contact with outer writing element 22). Spring 561 may also keep follower protrusion 582 in contact with helical cam surface 580. Keeping contact between protrusion 582 and cam surface 580 enables proper operation of driving mechanism 560, such as for reasons described above with respect to spring 61.

Driving mechanisms 60, 160, 260, 460, 560 can be actuated by moving (e.g., axially or rotatably) a component making up or coupled to driving mechanisms 60, 160, 260, 460, 560 as described above. Upon actuation of any of driving mechanisms 60, 160, 260, 460, 560, the moveable writing element is extended from outer barrel 12 so that its distal-most portion extends beyond the distal-most portion of the fixed writing element 20, 22. Therefore, the moveable writing element can be used to mark a surface. Thus, driving mechanisms 60, 160, 260, 460, 560 permit selection of a desired writing element 20, 22, with a simple operation. Driving mechanisms 60, 160, 260, 460, 560 enable a user to use one writing element 20, 22 one at a time or even at the same time if desired.

As shown in FIG. 3, in an embodiment in which driving mechanism 60, 160, 260, 460, 560 is actuated by movement of outer barrel 12 (or a portion thereof), front barrel proximal portion 21 may be coupled to back barrel distal portion 18 so as to permit relative rotational movement of barrels 14, 16, while inhibiting relative axial movement. To prevent front barrel 14 and back barrel 16 from separating, front barrel 14 may have external circumferential ribs 15. Moreover, as shown in FIG. 3, and more clearly in FIG. 4, back barrel 16 may have internal circumferential ribs 17. It is desirable that ribs 15, 17 are positioned to prevent axial movement of barrels 14, 16, with respect to each other, while still allowing for rotational movement of barrels 14, 16 with respect to each other. To accomplish this, each external circumferential rib 15 may be positioned adjacent to an internal circumferential rib 17. In the one embodiment, at least one external rib 15 can be positioned between two internal ribs 17. Or, at least one internal rib 17 can be positioned between two external ribs 15. Such a configuration prevents front barrel 14 and back barrel 16 from moving apart. Additionally, an O-ring (not shown) may be positioned inside back barrel distal portion 18 (other locations are also contemplated). An O-ring can provide smooth movement of barrels 14, 16 relative to each other and help prevent evaporation of writing medium (i.e., prevent writing elements 20, 22 from drying out). For instance, back barrel 16 can have a pair of internal circumferential ribs 17 with an O-ring or one circumferential rib 17 with an O-ring. The O-ring may be made of silicon rubber or any other suitable material. Various factors—for example, ability to provide a good seal and smooth movement between front and back barrel 14, 16—can be considered when selecting a suitable material to be used for the O-ring. Moreover, rib 19 (FIG. 3) may be provided on front barrel proximal portion 21 to abut back barrel distal portion 18 and thus to inhibit excessive distal movement of back barrel 16. It should be noted that a writing instrument cover (for example, cap 90 or 290 shown in FIG. 14 and 15, respectively, and described in further detail below) may engage rib 19 so that the writing instrument cover is held over the distal writing end of writing instrument 10.

Exemplary driving mechanism 60, 160, 260, 460, 560 may be located at proximal end 43 or distal end 41 of writing instrument 10 (FIG. 1), or anywhere in between. Preferably, the driving mechanism 60, 160, 260, 460, 560 is located at proximal end 43 of writing instrument 10 so as not to interfere with the components and arrangement of writing elements 20, 22. Driving mechanism 60, 160, 260, 460, 560, or components thereof may be directly accessible for actuation, for example, either by an opening in outer barrel 12 or by driving mechanism 60, 160, 260, 460, 560 not being covered by an outer barrel 12 at all. At least one writing element 20, 22 can be operatively coupled to driving mechanism 60, 160, 260, 460, 560. The other writing element 20, 22 is arranged to be movable independently of the at least one writing element connected to driving mechanism 60, 160, 260, 460, 560 and may be connected, for example, to outer barrel 12. In another embodiment, both writing elements 20, 22 can be connected to driving mechanism 60, 160, 260, 460, 560. It should be noted that neither writing element 20, 22 has to be directly connected to the driving mechanism 60, 160, 260, 460, 560. Preferably, there are no intermediary elements (not shown) connecting the driving mechanism 60, 160, 260, 460, 560 to one or both writing elements 20, 22.

Returning to writing elements 20, 22, since inner writing element 20 is mounted within outer writing element 22, inner writing element 20 is further (radially) from outer barrel 12, and, further (radially) from the distal opening in front nose cone 23 than in standard writing instruments. In one embodiment, front nose cone 23 may be made of a clear material, such as for aesthetic purposes. By using a clear material, the gap between outer writing element 22 and front nose cone 23 is not so readily apparent. Nevertheless, front nose cone 23 and, for that matter, any other part of writing instrument 10 can be made of clear material so that one can see the inner workings of writing instrument 10. Front nose cone 23 can be made of polypropylene or other plastic or polymer. The material chosen for front nose cone 23 may be selected, for example, based on cost, ease of manufacturing, and resistance to vapor transmission or air-tightness.

Moreover, in one embodiment, in order to allow for axial movement of writing elements 20, 22 with respect to each other, outer writing element 22 has an inner axial passage 24 (FIG. 2) that is larger than the outer diameter of inner writing element 20. Such a configuration can result in wobbling. Accordingly, it is desirable to address any resultant increased wobble. Individually, or in combination, rigidity of inner writing element 20 and the support provided by outer writing element 22 thus are preferably selected to minimize wobbling. While inner writing element 20 may obtain some support from inner axial passage 24 of outer writing element 22, outer writing element 22 may provide only minimal stabilization to counter wobbling. Therefore, it is generally desirable to exhibit care in selecting the rigidity of writing elements 20, 22.

Rigidity may be a function of various characteristics, such as wall thickness or material. Ideally, inner writing element 20 has an outer diameter small enough to fit within inner axial passage 24 of outer writing element 22 and, at the same time, a wall thickness such that inner writing element 20 can hold a sufficient quantity of writing medium. Such factors may influence the choice of material used for inner writing element 20. The material can be metal and/or plastic. Moreover, first writing reservoir 28 can be formed from a material different from the material of first writing tip 30. In one embodiment, first writing medium reservoir 28 and first writing tip 30 are made of plastic. For maximum stability of inner writing element 20, and to impart stability to outer writing element 22 as well, first writing medium reservoir 28 may be formed of metal. Other combinations of materials than those described herein may be used. Also, other materials presently known and those yet to be discovered may be used instead. Similarly, composite materials (i.e., combination of two or more materials) may be employed.

Because inner writing element 20 may be in contact with outer writing element 22, it will be appreciated that it may also be desirable to select a material that is resistant to corrosion especially when the outer writing element 22 has a filler-type writing medium reservoir. Resistance to corrosion is important because first writing medium reservoir 28 is positioned within inner axial passage 24. If inner axial passage 24 is made of a porous material that allows writing medium contained within outer writing element 22 to penetrate therethrough, the writing medium from outer writing element 22 may come into contact with the first writing medium reservoir 28. Over time, corrosion of first writing medium reservoir 28 could cause the writing medium within first writing medium reservoir 28 to leak into outer writing element 22 and vice versa. Furthermore, corrosion may affect the performance of writing instrument 10 because of resultant writing medium losses.

Additionally or alternatively, inner axial passage 24 of outer writing element 22 may have an internal sleeve (not shown), thereby reducing, if not eliminating, the concern with selection of corrosion resistant material. Such a sleeve may also be helpful in reducing, if not eliminating, wicking of writing medium from second writing medium reservoir 34, via inner axial passage 24, onto inner writing element 20. An inner sleeve may be provided in inner axial passage 24. The inner sleeve may be made of polyproplylene and can have a thickness of as little as approximately 0.1 mm or as great as approximately 0.5 mm. Other materials and thicknesses, however, may be used. For instance, if made of polypropylene, the inner sleeve may have a thickness of at least approximately 0.4 mm or at most approximately 1 mm. The inner sleeve may also be made of any shrinkable thermoplastic material, such as PET (polyethylene terephtalate), in which case, the thickness of the inner sleeve could be at least approximately 0.05 mm or at most approximately 0.8 mm. Various factors such as rigidity, chemical stability, and ease of manufacturing may be considered when selecting materials that may be used for the inner sleeve.

The minimum and maximum thicknesses of an inner sleeve formed of polypropylene are a function of the extrusion process and writing capacity, respectively. A thickness of approximately 0.4 mm is the minimum thickness which typically can be extruded. Therefore, it is possible that the minimum thickness could be less than 0.4 mm, depending on the manufacturing process and other relevant factors, as long as the sleeve is still able to perform its above-stated functions. Moreover, the maximum thickness could be greater than 1 mm. However, it will be appreciated that the use of an inner sleeve or increasing the thickness of an inner sleeve may affect various characteristics of the other components of writing instrument 10, such as the dimensions of elements. For example, altering the dimensions of outer writing element 22 may affect the capacity of outer writing element 22 to hold writing medium. In order to maintain the capacity of outer writing element 22 (i.e., the amount of writing medium held therein), various changes to writing instrument 10 could be made, to compensate for the presences of an inner sleeve or increased thickness of the inner sleeve (e.g., increasing the outer diameter or decreasing the wall thickness of outer barrel 12, or decreasing the thickness of an outer sleeve 80 (FIGS. 3, 5 and 6) discussed below).

Outer writing element 22 may comprise a porous nib and a filler-type writing medium reservior, which includes a filler material surrounded by a filler wrap. A filler wrap, such as filler wrap 78, may be typically designed to maintain rigidity (i.e., by preventing side walls of second writing medium reservoir 34 from collapsing when squeezed) and straightness (i.e., by allowing for smooth movement of outer writing element 22 within writing instrument 10). Filler wrap 78 may also function to hold filler material inside filler wrap 78. In addition, filler wrap 78 may act as a barrier, preventing writing medium from passing therethrough and getting on a user's hands and/or fingers. Filler wrap 78 may be made of polyethylene, polypropylene, polyamide (e.g., Nylon), polyester, or acetate and may have a minimum thickness of approximately 0.01 mm or a maximum thickness, which can be a function of the amount of space available within writing instrument 10 and manufacturing constraints. Various factors such as rigidity, chemical stability, and ease of manufacturing may be considered when selecting materials to be used. A sleeve, or other type of coating, may also be provided on the outer surface of outer writing element 22 (particularly if outer writing element 22 has a filler-type writing medium reservoir) to prevent leakage, inadvertent marking, and/or evaporation of the writing medium therein.

Referring now to FIG. 3, at least an outer portion of outer writing element 22 may be covered by sleeve 80, which can be non-porous or fluid-impervious (or at least, specifically impervious to writing medium). When sleeve 80 is non-porous or fluid-impervious, sleeve 80 can protect the user from getting writing or marking medium on his/her hands and/or fingers when manipulating outer writing element 22. Further, when outer writing element 22 comprises a filler-type writing medium reservoir as shown in FIG. 2, at least a portion of filler wrap 78 may be covered by sleeve 80 (FIG. 3). As shown in FIGS. 3, 5 and 6, sleeve 80 may also cover a portion of second writing tip 32 (particularly if in the form of a porous nib). Such construction prevents evaporation of writing medium (because less surface area of second writing tip 32 is exposed to air) and, thus, extends the life—both shelf life and usage life—of outer writing element 22. Moreover, as illustrated in FIGS. 5 and 6, sleeve 80 may also be provided over second writing tip 32 (particularly if in the form of a porous nib) and may act as a coupling member, such as to hold second writing tip 32 and second writing medium reservoir 34 together. The use of sleeve 80 thus allows for and facilitates refill of outer writing element 22 by joining second writing tip 32 and second writing medium reservoir 34 into a single component or unit. However, any structure or material that holds second writing tip 32 together with second writing medium reservoir 34 is envisioned—for example, a stainless steel or plastic peg or ring within tip 32 and/or reservoir 34; a clip or ring crimped, squeezed, or glued around tip 32 and reservoir 34; or adhesive, staple, or any other fastener.

Sleeve 80 may be provided over the filler material, filler wrap 78, and/or a porous nib. Sleeve 80 may be made of a shrinkable thermoplastic material—for example, PET (polyethylene terephtalate), polyethylene polyamide (e.g., Nylon), or PVC (polyvinal chloride)—or a polypropylene wrap. Various factors such as cost, strength, chemical stability, and ease of manufacturing may be considered when selecting material to be used for sleeve 80. If made of polypropylene, sleeve 80 may have a thickness of approximately 0.5 mm; however, a thickness as small as approximately 0.4 mm or as large as approximately 1.0 mm may be used. It will be appreciated that the thicker sleeve 80 is, the more like a structural element sleeve 80 becomes. Generally, it is desirable to form sleeve 80 from a material that permits sleeve 80 to be as thin as possible so that the presence of sleeve 80 has an insignificant affect on the overall diameter of writing instrument 10. More preferably, sleeve 80 is only as thick as necessary to impart the desired writing medium imperviousness and/or impermeability and does not play a structural role other than to hold outer writing element 22 and second writing tip 32 together. In other words, sleeve 80 may be so thin that it is not a structurally stable element independently of outer writing element 22, and merely provides a fluid barrier to filler-type writing medium reservoir 34. Sleeve 80 may be flexible.

Thus, sleeve 80 may be in the form of a wrap material, such as a heat-shrinkable sleeve, which permits formation of a sleeve with the smallest achievable thickness, thus contributing to maintaining a very small diameter for writing instrument 10. If made of PET, sleeve 80 may have a thickness of approximately 0.15 mm. The minimum thickness may be a function of the strength required to retain second writing tip 32 in second writing medium reservoir 34; the amount of available space in writing instrument 10 to allow for free movement of the driving mechanism (i.e., no binding); ability to consistently shrink to a particular wall thickness; resistance to tearing or splitting upon shrinking; and speed at which shrinking can occur. For instance, the minimum thickness can be approximately 0.05 mm. The maximum thickness is generally dictated by the maximum thickness of writing instrument 10 and may be approximately 0.5 mm. Another benefit of a heat-shrinkable sleeve over an injection molded sleeve is that a heat-shrinkable sleeve facilitates assembly.

In another embodiment, as illustrated in FIG. 12, cartridge case 418—formed of a material that prevents seepage of writing medium therethrough—may be provided over the filler-type outer writing element 22 instead of a sleeve 80. Sleeve 80 or cartridge case 418 may hold second writing tip 32 and second writing medium reservoir 34 together—i.e., second writing tip 32 is attached to second writing medium reservoir 34 and sleeve 80 or cartridge case 418 is positioned therearound, thereby holding these components together. Other benefits of sleeve 80 and cartridge case 418 may include: reduction in evaporation of writing medium from outer writing element 22 and added stability imparted thereby to writing elements 20, 22. Additionally, sleeve 80 and cartridge case 418 allow for clean and easy refill of outer writing element 22.

Refill may also be facilitated by constructing the above-described writing instrument to permit replacement of either writing element 20, 22. While prior art devices enable writing elements to be refilled (e.g., ball point pens, roller ball pens), no prior art device has allowed for refill of a porous nib-type writing element, or combination porous nib-type writing element and pen, pencil, marker, etc. The porous nib-type writing element can have a filler material (e.g., a filler-type writing medium reservoir) holding writing medium or may be fillerless (i.e., the ink is not contained in a filler material). Therefore, another feature of the present invention, independent of the above-described features, is the formation of a writing instrument with a porous nib-type writing element such that the porous nib-type writing element can be replaced when the writing medium contained therein is expended.

To enable replacement of one or both writing elements 20, 22, outer barrel 12 preferably is formed to permit access to one or both writing elements 20, 22. Moreover, writing elements 20, 22 are preferably removably positioned within outer barrel 12 to permit ready removal as desired. Access to writing elements 20, 22 can be at either distal end 41 or proximal end 43 of writing instrument 10. In the embodiment of FIGS. 1 and 3, outer barrel 12 has a removable front nose cone 23 formed to permit access to outer writing element 22, thereby allowing removal and replacement of writing elements 20, 22. Front nose cone 23 may have internal threads 27 to engage external thread 25 at the distal end of front barrel 14 so that front nose cone 23 can be threaded on and off front barrel 14. Yet, another embodiment may have both a removable front nose cone 23 and a removable back end button. Alternatively, front barrel 14 and back barrel 16 may be separable to permit access to writing elements 20, 22 therein.

FIG. 16 illustrates another replacement mechanism. Male cam 364 can function with mobile cam 62, 162, 262, 362 (shown as mobile cam 362) and end button 380 to form a replacement mechanism, thereby simplifying refill of writing elements 20, 22. Male cam 364, with mobile cam 62, 162, 262, 362 coupled thereto, can be inserted into back barrel 316, with engaging flats 369 engaging back barrel receiving flats 391 (FIG. 4). End button 380 is configured to facilitate locking of male cam 364 with respect to back barrel 316. As internal threads 382 of end button 380 are screwed onto external threads 381 of male cam 364, end button 380 is drawn closer to back barrel 316. Simultaneously, conical surface 383 pushes against cam inner surface 384, thereby pressing engaging flats 369 tightly against back barrel 316 and preventing axial movement of male cam 364 with respect to back barrel 316. To prevent rotational movement of male cam 364 relative to back barrel 316—for example, during operation of writing instrument 10—and to allow for end button 380 to be screwed thereon (i.e., keeping male cam 364 stationary while button 380 is being screwed on), protrusions 385 slide into notches 386 in back barrel 316. As end button 380 is screwed further onto external thread 381, tapered surface 389 is drawn into back barrel 316, creating a preferably air-tight fit between back barrel 316, male cam 364, and end button 380. Rotation of end button 380 onto male cam 364 stops when end button engagement surface 387 contacts back barrel engagement surface 388. Furthermore, male cam 364 may further include a sealing ring 390 to create an air-tight seal between male cam 364 and back barrel 316, thereby preventing the writing medium of writing elements 20, 22 from evaporating. Such an air-tight seal is particularly important when one or both of the writing elements carries a volatile writing medium.

Figure 17:
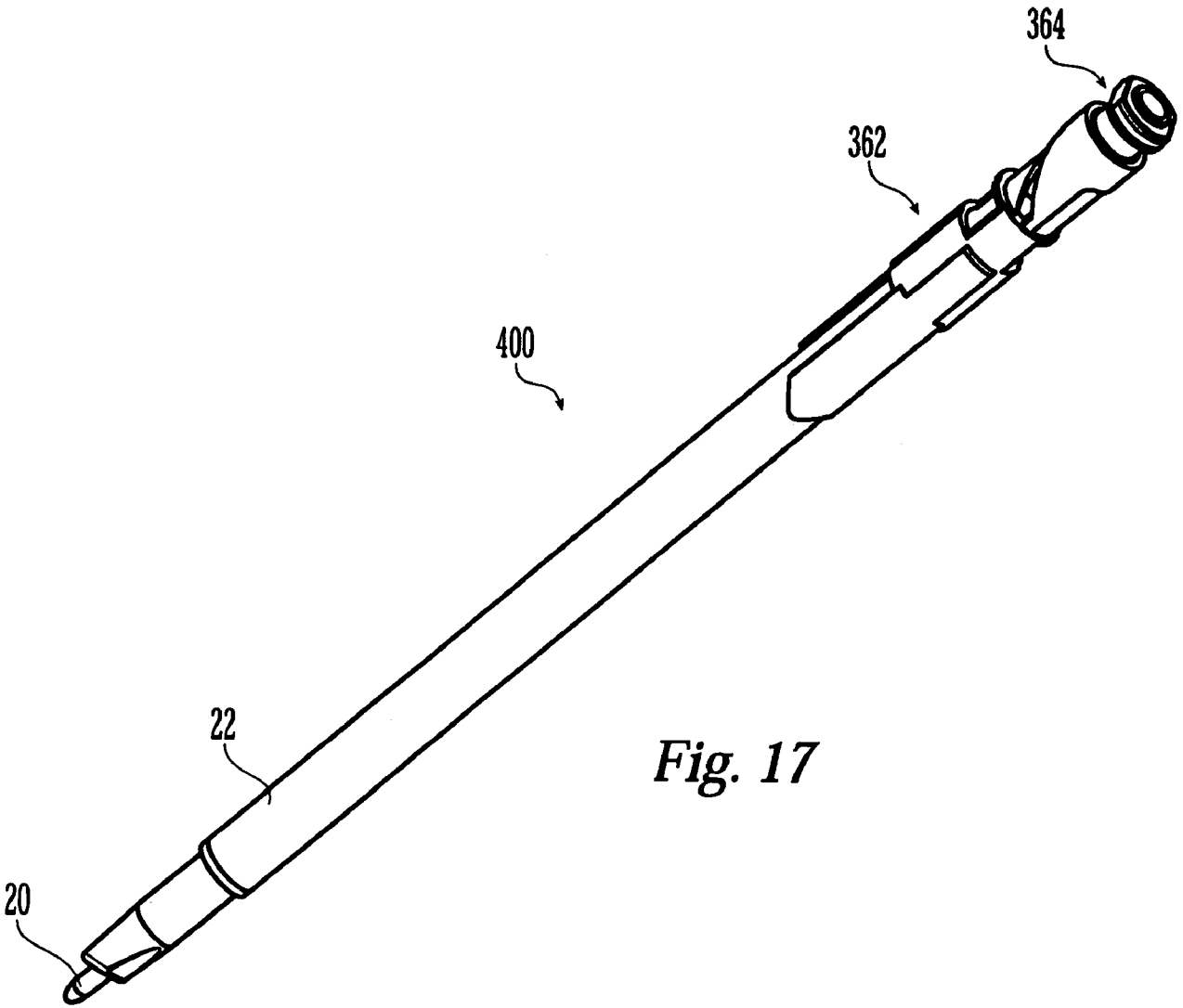
FIG. 17 is a perspective view of an exemplary refill set.

Using the replacement mechanism of FIG. 16, writing elements 20, 22 can be replaced when the writing medium of writing element 20 and/or 22 is expended. FIG. 17 illustrates one example of a refill set 400, which may include writing elements 20, 22; mobile cam 362; and male cam 364. It should be noted that mobile cam 362 and/or male cam 364 can be reused while only writing elements 20, 22 are replaced.

Figure 14:
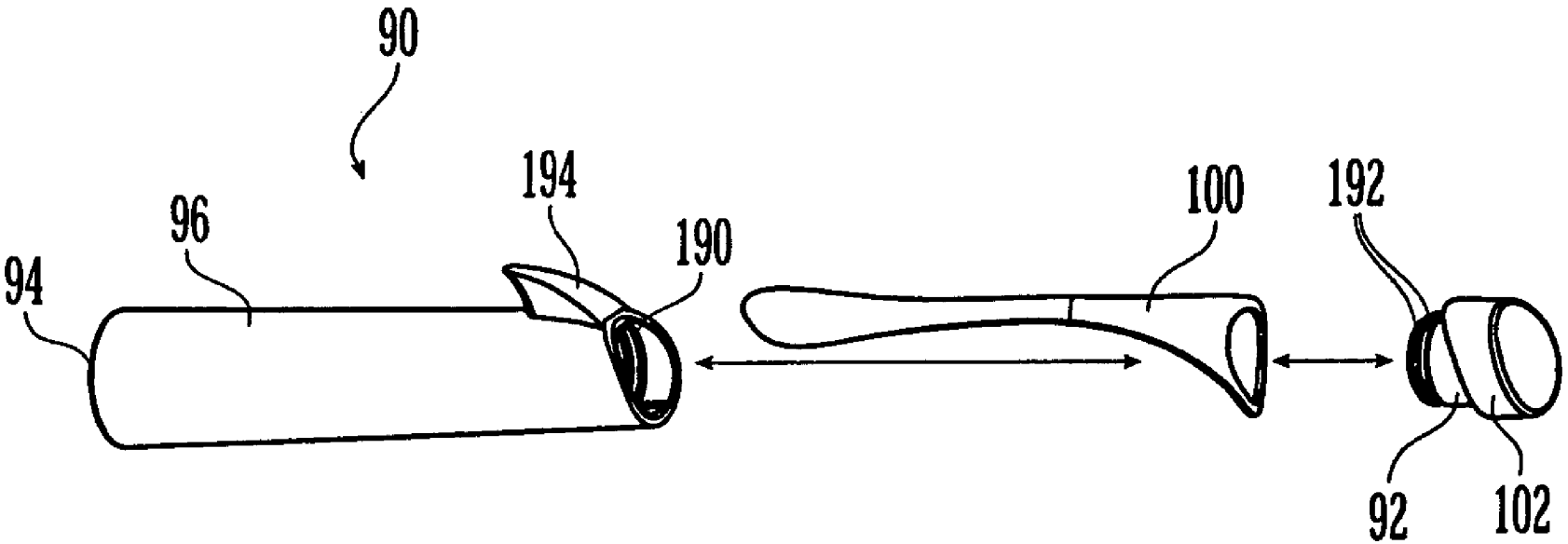
FIG. 14 is an exploded view of an exemplary cap that may be used on a writing instrument formed in accordance with the principles of the present invention.

If one of writing elements 20, 22 remains in an extended position (i.e., writing tip 30 or 32 is not retractable into a position within outer barrel 12), or if at least one of writing elements 20, 22 contains a volatile writing medium, it would be desirable to cover writing element 20, 22 to prevent evaporation of the volatile writing medium. A cap 90 as illustrated in FIG. 14 may be used. Cap 90 can be made of ABS or polypropylene (but other materials are also envisioned). Various factors such as ability to be welded or painted/decorated, resistance to vapor transmission or air-tightness, cost, and ease of manufacturing may be considered in selecting material to be used. Cap opening 94 can be placed over distal end 41 (FIG. 1) of writing instrument 10 and may be fixed thereto by engaging rib 19 on front barrel 14 (FIG. 3). However, any similar structure that adequately covers writing elements 20, 22 can be used instead of cap 90. It should be noted that a cap may be purely ornamental and/or not for the purpose of preventing drying of writing medium. That is, there may be other reasons for a cap to be placed over writing instrument 10. For instance, cap 90 may prevent breakage of first writing tip 30 or second writing tip 32. Also, cap 90 may avoid inadvertent marking resulting by either writing tip 30, 32.

If, as described above, the writing medium of at least one of writing elements 20, 22 is volatile, a vapor seal 92 preferably is provided within cap 90 to prevent evaporation of the writing medium. Vapor seal 92 can be placed within cap body 96 at a location permitting ready secure coupling to outer barrel 12 to seal writing elements 20, 22. Vapor seal 92 may be designed to seal both first writing tip 30 and second writing tip 32 by engaging distal end 93 (FIG. 3) of front nose cone 23. In another embodiment, vapor seal 92 may engage any distal portion of outer barrel 12.

While not necessary, clip 100 may also be provided on cap 90 so that writing instrument 10 may be attached to any object the user desires. Nevertheless, other attachment means may be used. Clip 100 may encircle vapor seal 92, contacting cap body 96, and resting on cap support 194. Furthermore, clip 100 can be secured to cap 90 by being positioned between cap body 96 and top cap 102. While any means of connected cap body 96 and top cap 102 is envisioned, FIG. 14 shows circumferential ribs 192 engaging circumferential ribs 190 to hold cap body 96 and top cap 102 together.

Figure 15:
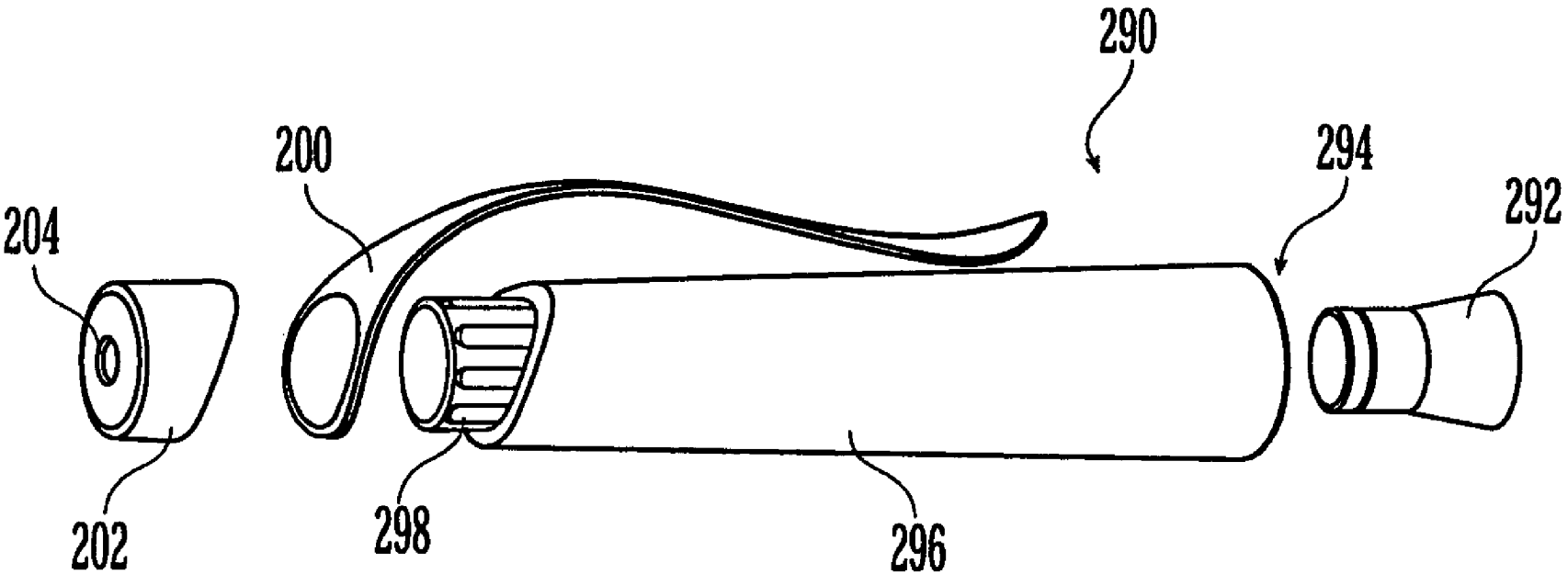
FIG. 15 is an exploded view of another exemplary cap that may be used on a writing instrument formed in accordance with the principles of the present invention.

Alternatively, cap 290 as illustrated in FIG. 15 may be used. Cap 290 can be made of ABS or polypropylene (but other materials are also envisioned). Similar to cap 90, various factors such as ability to be welded or painted/decorated, resistance to vapor transmission or air-tightness, cost, and ease of manufacturing can be considered in selecting material to be used for cap 290. Cap opening 294 can be placed over distal end 41 of writing instrument 10 and may be fixed thereto by engaging rib 19 on front barrel 14 (FIG. 3). A vapor seal 292 may also be provided within cap 290 to prevent evaporation of the writing medium. Vapor seal 292 can be placed within cap body 296 at a location permitting ready secure coupling to outer barrel 12 to seal writing elements 20, 22. Vapor seal 292 may be designed to seal both first writing tip 30 and second writing tip 32 by engaging distal end 93 (FIG. 3) of front nose cone 23. In another embodiment, vapor seal 292 may engage any distal portion of outer barrel 12. Cap 290 may be formed with a vent 298 and an opening 204, which allow air to flow through cap body 296 to prevent asphyxiation if cap 290 is swallowed. A clip 200 may also be provided on cap so that writing instrument 10 may be attached to any object the user desires. Clip 200 may encircle venting means 298, contacting cap body 296. Furthermore, clip 200 can be secured to cap body 296 by being positioned between cap body 296 and top cap 202.

While the foregoing description and drawings represent the preferred embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, and with other elements, materials, and components, without departing from the spirit or essential characteristics thereof. One skilled in the art will appreciate that the invention may be used with many modifications of structure, arrangement, proportions, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being indicated by the appended claims, and not limited to the foregoing description.

What is claimed is:

1. A writing instrument having a proximal end and a distal end, said writing instrument comprising:

an outer barrel having an open distal end at said distal end of said writing instrument and a proximal end at said proximal end of said writing instrument;

an inner writing element having a first writing tip and a first writing medium reservoir; and an outer writing element having a second writing tip and a second writing medium reservoir;

wherein:

said inner and outer writing elements are positioned in an inner axial passage extending through said second writing tip and said second writing medium reservoir;

said inner writing element is positioned in said inner axial passage through said second writing tip and said second writing medium reservoir;

said first writing tip is in direct operative contact with said first writing medium reservoir;

said second writing tip is in direct operative contact with said second writing medium reservoir; and said outer writing element is movable with respect to said outer barrel.

2. The writing instrument of claim 1, further comprising:

a driving mechanism operatively coupled to said outer writing element.

3. The writing instrument of claim 2, said driving mechanism is located at said proximal end of said writing instrument.

4. The writing instrument of claim 1, wherein said second writing tip is a porous nib.

5. The writing instrument of claim 4, wherein said porous nib comprises a connection component operatively coupling said porous nib to said first writing medium reservoir.

6. The writing instrument of claim 5, wherein said connection component is at least one prong.

7. The writing instrument of claim 5, wherein said connection component is an open-ended cylinder.

8. The writing instrument of claim 4, wherein said second writing medium reservoir is a filler-type reservoir.

9. The writing instrument of claim 8, wherein said second writing medium reservoir has a non-circular cross-section.

10. The writing instrument of claim 9, wherein said non-circular cross-section is oval.

11. The writing instrument of claim 4, wherein said first writing tip is selected from the group consisting of: porous nib, ball point, roller ball, stylus, chalk, charcoal, and lead.

12. The writing instrument of claim 1, wherein said inner writing element is a solid-type writing element.

13. The writing instrument of claim 1, wherein said inner writing element has a wall formed from a non-corrosive material.

14. The instrument of claim 1, further comprising:

a mobile cam coupled to a proximal end of said outer writing element;

a stationary cam coupled to said proximal end of said outer barrel, said mobile cam riding along said stationary cam to move said outer writing element axially with respect to said outer barrel; and a biasing element biasing said outer writing element into engagement with said mobile cain.

15. The writing instrument of claim 1, wherein:

said inner writing element is a structurally stable thin writing element;

said second writing tip is a porous nib; and said second writing medium reservoir is a filler-type reservoir.

16. The writing instrument of claim 1, further comprising a coil spring positioned about said second writing tip to bias said outer writing element in a proximal direction.

17. The writing instrument of claim 1, wherein:

said inner and outer writing elements are positioned in an outer barrel having an open distal end at said distal end of said writing instrument and a proximal end at said proximal end of said writing instrument; and said outer writing element is movable with respect to said outer barrel.

18. A writing instrument having a longitudinal axis, a proximal end, and a distal end, said writing instrument comprising:

an inner writing element having a first writing tip adjacent said distal end of said writing instrument, and a first writing medium reservoir, said first writing medium reservoir having a rear end;

an outer writing element having a second writing tip adjacent said distal end of said writing instrument, and a second writing medium reservoir, said second writing medium reservoir having a rear end;

a driving mechanism operatively coupled to at least said outer writing element; and a coil spring positioned about said second writing tip to bias said outer writing element in a proximal direction;

wherein:

an inner axial passage extends through said second writing tip and said second writing medium reservoir;

said inner writing element is positioned in said inner axial passage in said outer writing element;

said inner and outer writing elements are axially moveable with respect to each other;

said driving mechanism is located at said rear end of said second writing medium reservoir; and actuation of said driving mechanism causes axial movement of said outer writing element.

19. The writing instrument of claim 18, wherein said driving mechanism comprises a first driving member and a second driving member movably coupled to each other.

20. The writing instrument of claim 10, wherein:

said first driving member is operatively coupled to said inner writing element;

said second driving member is operatively coupled to said outer writing element; and one of said first and second driving members is coupled to at least a portion of said outer barrel such that movement of said portion of said outer barrel actuates said driving mechanism to move one of said writing elements axially.

21. The writing instrument of claim 18, wherein:

said driving mechanism further comprises:

a mobile cam coupled to a proximal end of said outer writing element; and a stationary cam coupled to said proximal end of said outer barrel, said mobile cam riding along said stationary cam to move said outer writing element axially with respect to said outer body; and said writing instrument further comprises a biasing element biasing said outer writing element into engagement with said mobile cam.

22. The writing instrument of claim 18, wherein:

said inner writing element is a structurally stable thin writing element;

said second writing tip is a porous nib; and said second writing medium reservoir is a filler-type reservoir.

23. A writing instrument having a proximal end, a distal end, and a longitudinal axis, said writing instrument comprising:

an inner writing element having a first writing tip and a first writing medium reservoir;

an outer writing element having a second writing tip and a second writing medium reservoir;

wherein:

said first writing element is a structurally stable thin writing element;

said second writing tip is a porous nib;

said second writing medium reservoir is a filler-type writing medium reservoir;

an inner axial passage extends through said second writing tip and said second writing medium reservoir;

said inner writing element is positioned in said inner axial passage through said second writing tip and said second writing medium reservoir;

said outer writing element is axially movable with respect to said inner writing element, and said first writing medium reservoir is a solid-type writing medium.

24. The writing instrument of claim 23, wherein said first writing medium reservoir is a tubular reservoir for holding writing medium.

25. The writing instrument of claim 23, wherein:

said inner writing element and said outer writing element are positioned in an outer barrel; and said outer writing element is axially movable upon rotating a portion of said barrel.

26. The writing instrument of claim 23, further comprising a fluid-impervious wrap material over said outer writing element, wherein said writing instrument further comprising an outer barrel having a removable member permitting access to said outer writing element for removal and replacement of said outer writing element.

27. A writing instrument having a longitudinal axis, a proximal end, and a distal end, said writing instrument comprising:

an inner writing element having a first writing tip adjacent said distal end of said writing instrument, and a first writing medium reservoir, said first writing medium reservoir having a rear end;

an outer writing element having a second writing tip adjacent said distal end of said writing instrument, and a second writing medium reservoir, said second writing medium reservoir having a rear end; and a driving mechanism operatively coupled to at least said outer writing element, wherein:

an inner axial passage extends through said second writing tip and said second writing medium reservoir;

said inner writing element is positioned in said inner axial passage in said outer writing element;

said inner and outer writing elements are axially moveable with respect to each other;

said driving mechanism is located at said rear end of said second writing medium reservoir;

actuation of said driving mechanism causes axial movement of said outer writing element;

wherein said driving mechanism further comprises:

a mobile cam coupled to a proximal end of said outer writing element;

a stationary cam coupled to said proximal end of said outer barrel, said mobile cam riding along said stationary cam to move said outer writing element axially with respect to said outer body; and said writing instrument further comprises a biasing element biasing said outer writing element into engagement with said mobile cam.

* * * * *